US006150755A

United States Patent [19]

Druz et al.

[11] Patent Number: 6,150,755

[45] Date of Patent: Nov. 21, 2000

[54] CHARGED PARTICLE SOURCE WITH LIQUID ELECTRODE

[75] Inventors: Boris L. Druz, Brooklyn; Alan V. Hayes, Centerport; Victor Kanarov, Bellemore; Salvatore A. DiStefano, Bayshore; Emmanuel N. Lakios, Mt. Sinai, all of N.Y.

[73] Assignee: Veeco Instruments, Inc., Plainview, N.Y.

[21] Appl. No.: 09/358,454

[22] Filed: Jul. 21, 1999

Related U.S. Application Data

[62] Division of application No. 08/745,950, Nov. 8, 1996, Pat. No. 5,969,470.

[51] Int. Cl.[7] ..... H01J 27/16

[52] U.S. Cl. ..... 313/359.1; 313/362.1; 313/231.61; 313/231.31

[58] Field of Search ..... 313/359.1, 362.1, 313/231.61, 231.31; 315/111.01, 111.21, 111.31, 111.81

[56] References Cited

U.S. PATENT DOCUMENTS

| | | | |
|---|---|---|---|
| 3,913,320 | 10/1975 | Reader et al. | 60/202 |
| 4,471,224 | 9/1984 | Cuomo et al. | 250/423 R |
| 4,490,229 | 12/1984 | Mirtich et al. | 204/192 C |
| 4,680,507 | 7/1987 | Uemura et al. | 315/111.81 |
| 4,684,848 | 8/1987 | Kaufman et al. | 315/111.81 |
| 4,707,637 | 11/1987 | Harvey | 315/111.81 |
| 4,739,214 | 4/1988 | Barr | 313/362.1 |
| 4,778,561 | 10/1988 | Ghanbari | 156/643 |
| 4,873,467 | 10/1989 | Kaufman et al. | 313/360.1 |
| 4,883,467 | 11/1989 | Franetzki et al. | 604/152 |
| 5,130,607 | 7/1992 | Lama | 315/111.81 |
| 5,198,718 | 3/1993 | Davis et al. | 313/359.1 |
| 5,216,330 | 6/1993 | Ahonen | 315/111.21 |
| 5,266,409 | 11/1993 | Schmidt et al. | 428/446 |
| 5,274,306 | 12/1993 | Kaufman et al. | 315/111.41 |
| 5,434,469 | 7/1995 | Ciri | 313/362.1 |
| 5,508,368 | 4/1996 | Knapp et al. | 427/534 |
| 5,825,035 | 11/1998 | Mizumura et al. | 315/111.81 |
| 5,936,251 | 8/1999 | Gierak et al. | 313/362.1 |

OTHER PUBLICATIONS

Extracts from Bernhard Wolf (ed.), *Handbook of Ion Sources*, CRC Press Inc., Boca Raton, LA (1995) (no month) pp. 209–312.

"State of the Art of the RIT Ion thrusters and Their Spin Offs", Loeb et al., IAF–88–258 Preprint, 39th Congress of the International Astronautical Federation , Oct. 8–15, 1988/ Bangalore, India pp. 1–16.

Proceedings of the 4$^{th}$ Annual Microelectronics Symposium "Molecular Concepts in Microelectonics", pp. 2A–1–2A–8 (May 24–26, 1965).

Journal of Applied Physics, "Ion–Beam Deposition of Thin Films of Diamondlike Carbon" 42:7, pp. 2953–2958 (Jun. 1971) by S. Aisenberg et al.

(List continued on next page.)

*Primary Examiner*—Michael H. Day
*Attorney, Agent, or Firm*—Morgan & Finnegan LLP

[57] ABSTRACT

A charged particle source includes a vessel defining an interior for containing a plasma, the vessel having an inlet communicating with the interior of the vessel and connected to a source of atoms, and an aperture through which a charged particle beam is discharged, an energy generator for communicating with the atoms in the interior of the vessel and effecting ionization of the atoms in the vessel and creating the plasma, an electrode assembly disposed in the interior of the vessel, the electrode assembly including a conductive electrode support member, a tray member associated with the support member, a conductive liquid disposed in the tray member, the liquid having a surface area and a conductor connected between the conductive liquid and a voltage source, and an ion optics assembly disposed adjacent the vessel for accelerating plasma-generated charged particles having the same polarity as the conductive liquid in the vessel while maintaining charged particles of the opposite polarity within the vessel.

11 Claims, 14 Drawing Sheets

OTHER PUBLICATIONS

"Ion Beam and Plasma Methods of Producing Diamondlike Carbon Films", pp. 1–16 (Aug. 14–19, 1988) by D. Swec et al.

"SOA of the RIT–Ion Thrusters and Their Spin–Offs" International Aerospace Abstracts, A89–17746, p. 650 (1988) (no month).

"A Reaction Sputtering Type RF Source for Solid Elements" by C. Shichang et al. Nuclear Instruments & Methods in Physics Research, V. B37/38, pp. 136–139 (1989) (no month.

"An R.F. Ion Beam Source and Ion Beam Depositions . . . on . . . Substrates" Surface and Coatings Technology, v. 56, pp. 157–163 (1993) by H. Khan et al. (no month).

European Search Report, Apr. 2, 1998.

CHARGED PARTICLE SOURCE WITH LIQUID ELECTRODE

This is a divisional of application Ser. No. 08/745,950 filed Nov. 8, 1996, now U.S. Pat. No. 5,969,470.

FIELD OF THE INVENTION

The invention relates to the field of charged particle sources including broad-beam ion sources for ion beam deposition and etching, and electron sources for surface modification.

BACKGROUND OF THE INVENTION

Charged particle sources are used for various surface modification, etching and deposition applications, and are particularly advantageous compared to other methods for providing direct control of particle energy and flux, angle of incidence to the substrate, and isolation of the substrate from the conditions of the reactor used to generate the etching and or depositing species.

Broad-beam ion sources, in particular, have numerous applications in microelectronics device fabrication. Ion beam equipment is already extensively used, for example, in the production of high frequency microwave integrated circuits and thin magnetic heads.

In surface modification or ion beam etching, generally known as "ion milling", a beam of ions is extracted from a plasma ion source by electrostatic methods and is used to remove material from a substrate mounted in the path of the beam. In reactive ion milling methods, certain chemical(s) are introduced to the ion source or to the etching chamber which cause chemical reactions to occur on the substrate as part of the milling process. Often the chemical process is affected by energetic assistance by the plasma (in the ion source) and/or the ion beam. An example is the addition of "inert" tetrafluoromethane gas to the ion source, which is broken up into various reactive fluorinated species that increase the rate of etching of certain substrates, such as aluminum oxide or silicon dioxide.

There are two basic configurations for ion beam deposition. In "primary" or "direct" ion beam deposition, an ion beam source is used to produce a flux of particles, including constituents of the desired film, which are accumulated at the substrate. In one category of "primary" ion beam deposition, the deposited material is formed by reactive means from precursor chemicals introduced to the ion source, usually in the gas phase. An example of great practical value is diamondlike carbon films formed from direct ion beam deposition from an ion source operated on hydrocarbon gas(es), such as methane.

The other general configuration in which ion beams can be used for thin film deposition is commonly known as "secondary ion beam deposition", or "ion beam sputtering". In this method, an ion beam consisting of particles that are not essential to the deposited film are directed at a target of the desired material, and the sputtered target material is collected on the substrate. Secondary ion beam deposition can be a completely inert sputtering process. Alternatively, certain chemicals can be added to the ion source or elsewhere in the deposition chamber to alter the chemical properties of the deposited film either by reaction with the target material or with the substrate. This can be done with or without energetic activation by the ion source plasma or the ion beam.

Other types of charged particle sources include electron sources and negative ion sources. Electron beams can be used in industrial applications for property or reactive modification of thin films. Electron beams are distinguished from ion beams in that the electrons have almost no momentum, and thereby are less disruptive to the surface of the substrate. Negative ion sources have been developed for research no application. In particular, beams of negative hydrogen ions are of interest for possible use in fusion energy sources.

In a typical charged particle source (or gun) electron bombardment of neutral gas atoms or molecules in a contained vessel is employed to create a plasma from which the desired charged particle species is extracted by an appropriate means. A continuous, stable, efficient and practical particle beam source typically comprises the following basic components: (1) a mechanism to provide an uninterrupted supply of fresh neutral gas species; (2) an energizing device to ensure constant supply of high energy electrons for ionization; (3) a facility for continuous removal of spent gas species and control of the operating pressure by a high vacuum pumping system, which is located in the process chamber on which the particle gun is mounted; (4) a mechanism of controlling the energy of the particle beam with respect to the target at which it is aimed, through control of the plasma potential with respect to ground; (5) a device for enabling the extraction of the desired particles through an opening in the charged particle source while simultaneously preventing particles of the opposite charge from leaving the charged particle source through the same opening (the particle optics); and (6) a mechanism to electrically compensate the plasma for the extraction of charged particles of one polarity in order to maintain its quasi-neutrality (to prevent charging of the charged particle source and subsequent instability)

In practice, components (4) and (6) are the same. That is, the electrode and power supply which controls the plasma potential with respect to ground by charging the plasma also maintains the plasma stable at that level by providing a path for charge compensation. This electrode shall be referred to herein generally as the "plasma potential control electrode." For example, in an ion source, the ion current which is extracted from the ion source is compensated by an equal current of electrons extracted from the plasma to ground through the plasma potential control electrode, which is connected to a positive high voltage beam supply. For a source of positively charged particles, the plasma potential control electrode is referred to as the "anode."

In a typical source, the ionizing electrons are produced from a cathode which is connected to the negative terminal of a discharge power supply, the positive terminal of which is connected to an anode which is in contact with the plasma. The energy of the electrons is controlled by the voltage of the discharge power supply. For example, in order to efficiently ionize Ar ions, the discharge voltage should be greater than 15 eV and is typically set between 20 eV and 60 eV. The plasma and the entire discharge power supply is electrically isolated from ground and floated to the desired plasma potential by connection with the beam power supply. This connection is usually made to the discharge cathode or anode described previously. For example, to provide an ion beam of singly charged Argon ions with a desired energy of about 500 eV, the positive terminal of the beam supply is connected to the discharge anode and set to 500 V. The cathode is usually a heated filament or hollow-cathode, but may also be a cold cathode emission. As a second example, to provide a 1 kev electron beam, the negative terminal of the beam supply is connected to the discharge anode and set to 1000 V. Charged particle sources which use the above described methods of plasma generation are categorized as "DC" sources.

An early version of an industrial DC source is described in U.S. Pat. No. 3,913,320 issued in 1975 to Reader and Kaufman. This type of ion source was developed originally for space propulsion. Various modifications of the Kaufman source have since been disclosed, which are primarily designed to optimize the efficiency of the source and to improve the method of extracting the ions or shaping the beam profile for ion beam etching and deposition applications. See for example U.S. Pat. No. 4,873,467 issued in 1989 to Kaufman. The above described sources have in common the use of a heated cathode, either a heated filament or hollow cathode. A cold cathode electron emitter which may be used as an ionization source in the chamber of an ion gun is described in U.S. Pat. No. 4,739,214 issued in 1988 to Barr. A cold cathode plasma anode electron gun is described in U.S. Pat. No. 4,707,637. U.S. Pat. No. 4,684,848 discloses a broad beam electron source. Various ion sources designs including negative ion sources (e.g. p. 299–309) are discussed in the *Handbook of Ion Sources*, ed. by B. Wolf, published in 1995 by CRC Press.

DC sources have disadvantages compared with other sources for etching and thin film deposition techniques in terms of charged particle source maintenance and reactive gas compatibility. Charged particle sources with filament type cathodes, for example, are the easiest to operate and maintain, but require frequent replacement of the filament assembly. Furthermore the hot filaments are rapidly attacked in the plasma state by gases which are useful for thin film deposition and etching, such as hydrocarbons, oxygen, hydrogen, and fluorinated gases. Charged particle sources equipped with hollow cathodes are difficult to maintain. They also cannot be operated with high concentrations of reactive gas because the hollow cathodes are easily contaminated and must be protected by continuous purging with inert gas. Cold cathodes can be readily maintained and are compatible with some reactive gases (e.g. oxygen) but have other limitations, such as generally low particle beam density, and poor beam collimation. These shortcomings of DC sources hinder the implementation of ion beam processes in manufacturing processes.

We have found that the above-mentioned disadvantages can be avoided by using radio frequency (RF) charged particle sources which employ high frequency electromagnetic energy for ion generation, including microwave energy sources. An optimally designed RF charged particle source has the following general attributes:

- applicability for reactive gases like oxygen, halogen components, etc. due to absence of discharge filaments;
- simple and rugged design easy to assemble and dissemble modest power supply and control requirements, easy ignitability;
- discharge stability, reliable fault-free and long duration operation;
- reduced concern for contamination of substrates due to reduced sputtering of the source components and materials and optimized material design (e.g. quartz instead of stainless steel chamber).

RF Inductively coupled ion sources were originally developed for space propulsion starting in 1960. See "State of the Art of the RIT-Ion Thrusters and Their Spin-Offs" by H. Loeb, et. al. of Giessen University (1988) which describes an ion source with an axial RF coil. An inductively coupled RF ion source with a flat RF coil design is disclosed in U.S. Pat. No. 5,198,718 granted to Davis, et. al., in 1993. An ion source with an internal RF coil is shown on p. 104 of Wolf's Handbook. RF capacitively coupled ion sources, such as the one shown on p. 230 of Wolf's Handbook, and U.S. Pat. No. 5,274,306 issued December 1993 to Kaufman are also known. An electron cyclotron resonance ion source is described by Ghanbari in U.S. Pat. No. 4,778,561 issued in 1988.

In contrast with DC sources, many RF sources do not require any discharge electrodes directly in contact with the plasma. However as mentioned above, an electrode must be provided to control the plasma potential and provide for charge compensation of the plasma. This may be combined with some other function. For example, in Loeb (1988) this function is performed by the gas distributor. In U.S. Pat. No. 5,198,718 it is performed by the "screen" grid portion of the ion optics.

One general limitation of prior art charged particle sources in practical applications is the formation of high electrical resistivity precipitates or films on electrode surfaces as a result of decomposition of certain gases or from physical sputtering of other dielectric materials. Such dielectric materials may, for example, include the walls of the plasma vessel, which are often constructed of quartz in RF and microwave plasma sources. In general, plasma and radical concentrations are strongly sensitive to reactor surface conditions. Changes in the conductivity of the electrode surfaces can lead to problems of aging and irreproducibility and can cause charge buildup in the ion source by inhibiting current flow between the plasma and the electrode which is used to control the plasma potential.

Stability improvement can be achieved by special source conditioning procedures. However, the problems of aging and irreproducibility become more complicated if conditioning of the source internal surfaces and source operation is accompanied with deposition on the walls and electrodes of high electrical resistivity precipitates.

In practical applications there are many gases such as hydrocarbon, halocarbon gases, etc. that react inside the charged particle source during operation to form large amounts of high electrical resistivity precipitates. For these cases the abovementioned limitation greatly hinders the application of charged particle sources for production thin film deposition and etching.

There is a clear need for the broad-beam charged particle source utilizing reactive gases that is capable to prevent accumulation of electrical charge in the source during the source operation.

It is an object of the present invention to provide a stable charged particle source, especially for operation with reactive gases, such as hydrocarbons, halocarbons, etc. that may form high electrical resistivity precipitates inside of the source.

SUMMARY OF THE INVENTION

The foregoing object can be achieved according to the present invention in the form of a charged particle source including a particularly configured electrode for controlling the plasma potential. The invention also contemplates a charged particle source having means for operating the source in a pulse mode so as to inhibit charge accumulation in the source during charged particle extraction.

In a first embodiment of the present invention, the charged particle source includes a conductive electrode controlling the plasma potential, the electrode comprising a liquid having metallic conductivity.

In a second embodiment of the invention, the plasma potential control electrode contains areas effectively hidden from the plasma and shielded from direct impingement of involatile product generated by operation of the charged particle source, for example as a result of plasma ionization and dissociation. The electrode may include means for flowing gas through these shielded areas.

In a third embodiment of the invention, the conductive electrode controlling the plasma potential contains hidden areas shielded from direct impingement of involatile product which are gradually exposed to the plasma by some motional mechanism of the shield or electrode component.

In a fourth embodiment of the invention, the source may be a positively charged particle source including means for applying a pulsed potential to the conductive plasma potential control electrode, which may be the "screen" grid in a multigrid ion optics assembly. The "accelerator" grid is fixed to the desired value for charged particle extraction, e.g. between −5 to 3000 V and the "decelerator" grid, if employed, is fixed to the desired value for charged particle extraction, typically ground potential. During, the first part of the period, the potential applied to the conductive electrode is 10 to 3000 V, and the second part of the period it is set equal to the potential of the "accelerator" grid. The above polarities would be reversed when the source is a negatively charged particle source.

These and other embodiments and advantages of the present invention will be further described and more readily apparent from a review of the detailed description and preferred embodiments which follow.

DETAILED DESCRIPTION OF THE INVENTION

Figure 1:
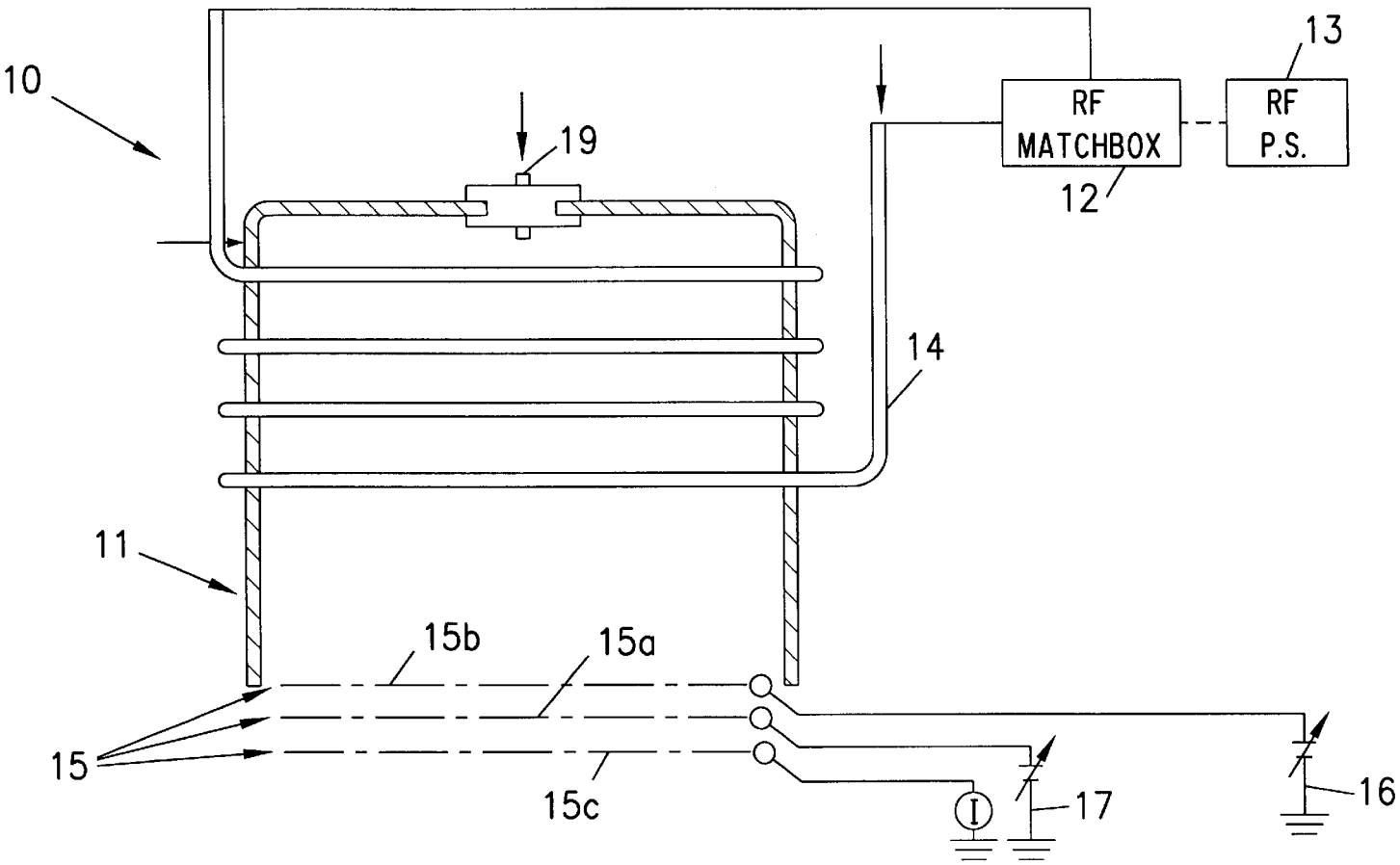
FIG. 1 PRIOR ART
FIG. 1 is a schematic ill n of an inductively coupled RF charged particle source with helical RF coil in accordance with the prior art.

FIG. 1 is a schematic diagram illustrating an inductively coupled RF charged particle source known in the prior art. This depiction is for illustrative purposes only. Other types of charged particle sources, including RF capacitively coupled or helicon wave coupled sources, as well as RF inductively coupled sources with internal RF coils and electron cyclotron resonance sources, electron and negative ion sources, and others are known to persons skilled in the art and need not be described in detail.

As shown in FIG. 1, a prior art inductively coupled RF charged particle source 10 typically includes a plasma discharge vessel 11 which may be made of quartz. The source 10 further includes an RF matchbox 12, an RF power supply 13 connectable to the matchbox and an RF applicator or energy generator 14 which is depicted in FIG. 1 as a water cooled RF induction coil. Coil 14 is connected to matchbox 12, and as illustrated, vessel 11 is disposed within coil 14.

The source 10 further includes a multihole three grid electrode assembly 15 which substantially contains the plasma within discharge vessel 11 and controls the extraction of ions from the vessel. A first grid 15*a*, commonly termed the "accelerator", is connectable to a negative high voltage supply 17. This grid includes a plurality of apertures configured in known fashion to optimize confinement of the plasma within plasma vessel 11 while allowing and, in part, directing the extraction of ions from the plasma. In this depiction, a "screen" grid 15*b* is disposed between the plasma and the accelerator grid. It is shown as a conductive electrode which is connected to a positive high voltage ion beam power supply 16. Thus, grid electrode 15*b* is the electrode which controls the potential of the plasma, which is also effectively also the "beam voltage." Ions are extracted from the plasma through the "ion optics" 15. To maintain quasi-neutrality of the ionized plasma an equivalent number of electrons to the number of ions being extracted must be removed from the plasma. These electrons are collected on the "screen" grid in this example and flow through the beam power supply, causing a indicated "beam current" reading.

A third grid 15*c*, known as the "decelerator" is at electrical ground potential. A neutralizer (not shown) supplies low energy electrons to the ion beam to neutralize the positive space charge. Working gas is provided inside of the source through an inlet 19 (not detailed). In alternative embodiments of this ion source, conductive elements in contact with the plasma other than the screen grid are used to serve as the electrode that is connected to the ion beam power supply and is used to control the plasma and the beam potentials. In these cases, the screen grid can be coated with a nonconductive material.

To illustrate the generation of high electrical resistivity precipitates inside of the source, we consider operation of a helical inductively coupled source, namely the Veeco Microetch RIM-210, on methane. Performance runs of two hours or more were conducted with the beam voltage in the range of 100–900 V, the accelerator voltage was −400 V, and the gas flow was 20 sccm. We observed three distinct periods of system behavior during the runs. The first period, about 30 to 40 min., was characterized by stable operation; the second period, about 70 to 90 min., by instability in the ion beam current of about 10% of average magnitude; the third period of about 90 to 100 min., by extinction of the plasma (during this period the plasma could be reignited and maintained for a short time, about 40 sec). After this period however the plasma could not be restored. While the exact time of these periods varied depending on operating parameters, the trends remained the same. In addition, at low beam voltage we observed an increase of the accelerator grid current from 20 to 30 mA.

Direct observation of the source walls and grids after the runs demonstrated deposition of high resistivity precipitates all over the source internal surfaces. These findings are related to the source operational problems as follows:

Coating of the conductive electrode which is used to control the plasma potential by high electrical resistivity precipitates causes drastic changes in plasma conditions. Precipitates on the electrode appear as a resistive layer that is introduced between the electrode and the plasma. Obviously, there is a voltage drop across this layer. As soon as the layer becomes thick, its resistivity increases until the voltage drop exceeds the electrical breakdown limit. Arcing in the source caused by electrical breakdown causes unstable source operation and eventually the plasma is extinguished.

A secondary effect which can be observed after long term operation of some charged particle sources with particular working gases is the deposition of a resistive layer on the accelerator grid or other grids downstream of the screen grid, particularly along the circumference of each aperture. This is presumably due to the incidence on the grid of particles streaming from the plasma, perhaps from the tails of the extracted beamlets. This can lead to electrical surface charging and modification of inter-grid electrical field configuration. As a result, deterioration of the beam collimation, backstreaming of oppositely charged particles from the chamber into the source and the consequent occurrence of a false beam current reading, and an increased accelerator grid current can occur.

Figure 2:
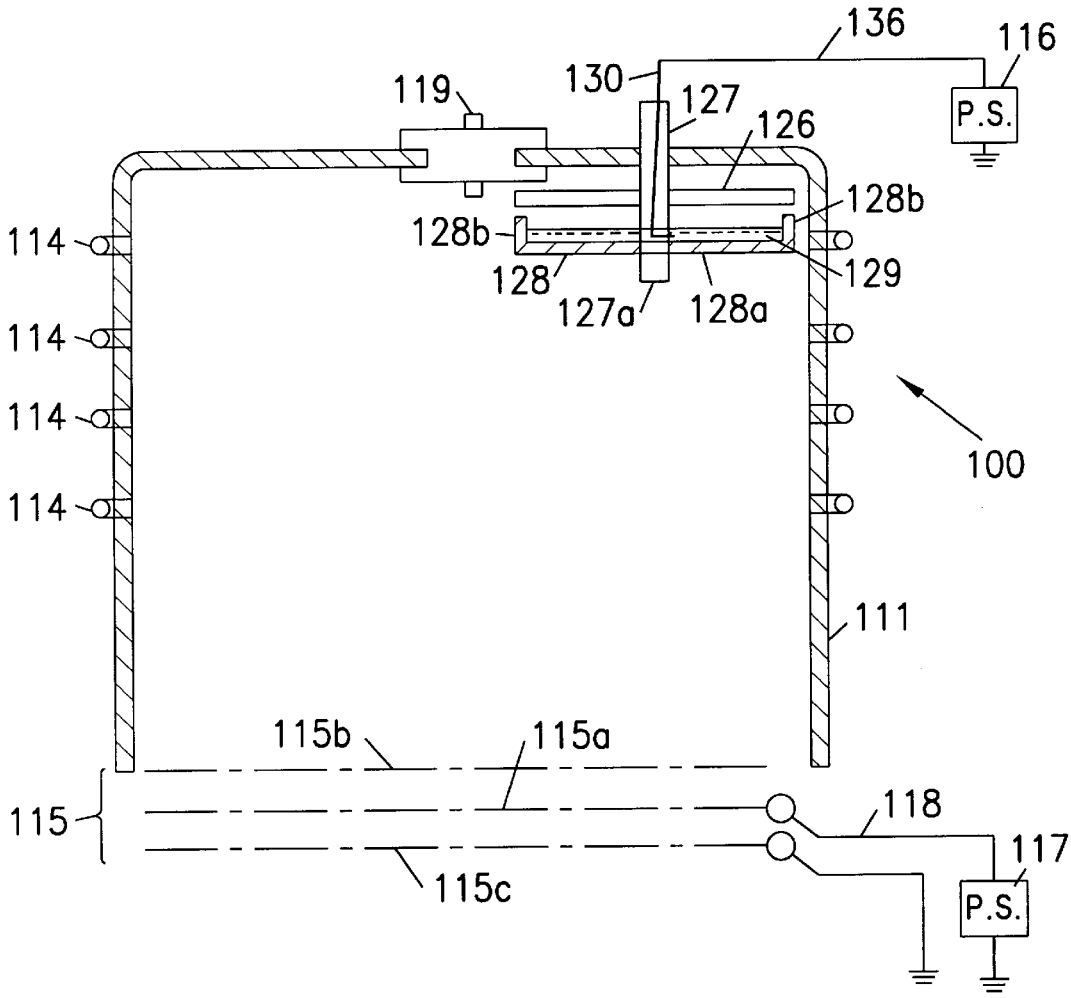
FIG. 2 is a schematic diagram illustrating a charged particle source in accordance with a first embodiment of the invention.

Referring to FIG. 2, a first embodiment of the subject charged particle source, designated generally by reference numeral 100, is schematically illustrated. For illustrative purposes only, and by no means in a limiting way, the source 100 is depicted as an inductively coupled RF ion beam source. It also will be understood that different mechanisms for generating the requisite plasma may be employed and that the source may be operated in reverse polarity to extract negatively charged particles.

As shown in FIG. 2 the charged particle source includes a plasma discharge vessel 111 which may be made of quartz. The vessel 111 defines an interior portion 111*a* in which the requisite plasma is generated. At one end of the vessel 111*b* is disposed an inlet 119 connectable to an external supply (not shown) of the plasma forming atoms which supplies a working gas to the inside of the discharge vessel. One end 111*c* of the plasma vessel is generally open. The source further includes an RF matchbox, an RF power supply connectable to the matchbox, and an RF applicator connected to the matchbox. For the sake of clarity, these well known elements are not shown in FIG. 2. It will be understood that they may be configured as shown in FIG. 1.

An electrode support member 127 extends through surface 111B of the vessel and has an end portion 127*a* disposed in vessel ill. Preferably, support member 127 is hollow. An anode tray member 128 is disposed at end 127*a* of electrode support member 127. As illustrated, tray 128 includes a base portion 128*a* and an upright wall portion 128*b* defining an interior. Disposed in the interior of tray 128 is a conductive liquid material 129, such as gallium, which is a liquid under the operating conditions of the plasma and which functions as an electrode. An electrical conductor 130 is disposed in the liquid electrode 129 and is connectable, through electrode support member 127 to a positive voltage power supply 116 by conductor 136. Preferably the source 100 also includes a plate 126 or other generally flat surface disposed in close proximity to tray 128 but spaced sufficiently far away to allow unimpeded contact between the bulk plasma and the liquid electrode. This surface could be the wall of the plasma vessel 111 or could be part of a baffle assembly for redistribution of the incoming gas from inlet 119.

An ion optics assembly, e.g. a grid assembly 115, is disposed adjacent to open end 111*b* of vessel 111. Grid assembly 115 may comprise one or more grids having a plurality of apertures configured in known fashion to optimize confinement of the plasma within vessel 111 while allowing and in part directing the extraction of ions from the plasma. Grid 115*a* is connectable to a negative high voltage supply 117 by conductor 118. Grid assembly 115 may also include a separate "screen" grid 115*b* which can be coated with a non-conductive material. Grid 115*b* us situated between grid 115*a* and the plasma. Assembly 115 may also include an decelerator grid 115*c* which is usually connectable to ground potential. The source 100 may also include a neutralizer (not shown) disposed adjacent to grid assembly 115. Multigrid ion optic designs and ion beam neutralizers are well known and need not be described in detail.

In accordance with the invention, the electrode assembly which includes the liquid electrode 129 and electrode tray 128 are configured to inhibit undesirable deposition of highly resistive material that can impair operation of the charged particle source. Because anode 129 is a liquid, it is essentially insensitive to precipitate contamination; the amount of such precipitates are negligible compared to the liquid of the electrode. The precipitates are effectively destroyed by being mixed in with the liquid of the electrode.

As a concrete example of the invention described in FIG. 2, a circular electrode tray 128 of diameter 5 cm and height 2 cm is filled with gallium to a height of 1 cm and installed in an ion source having a quartz bowl diameter of 25 cm.

Figure 3:
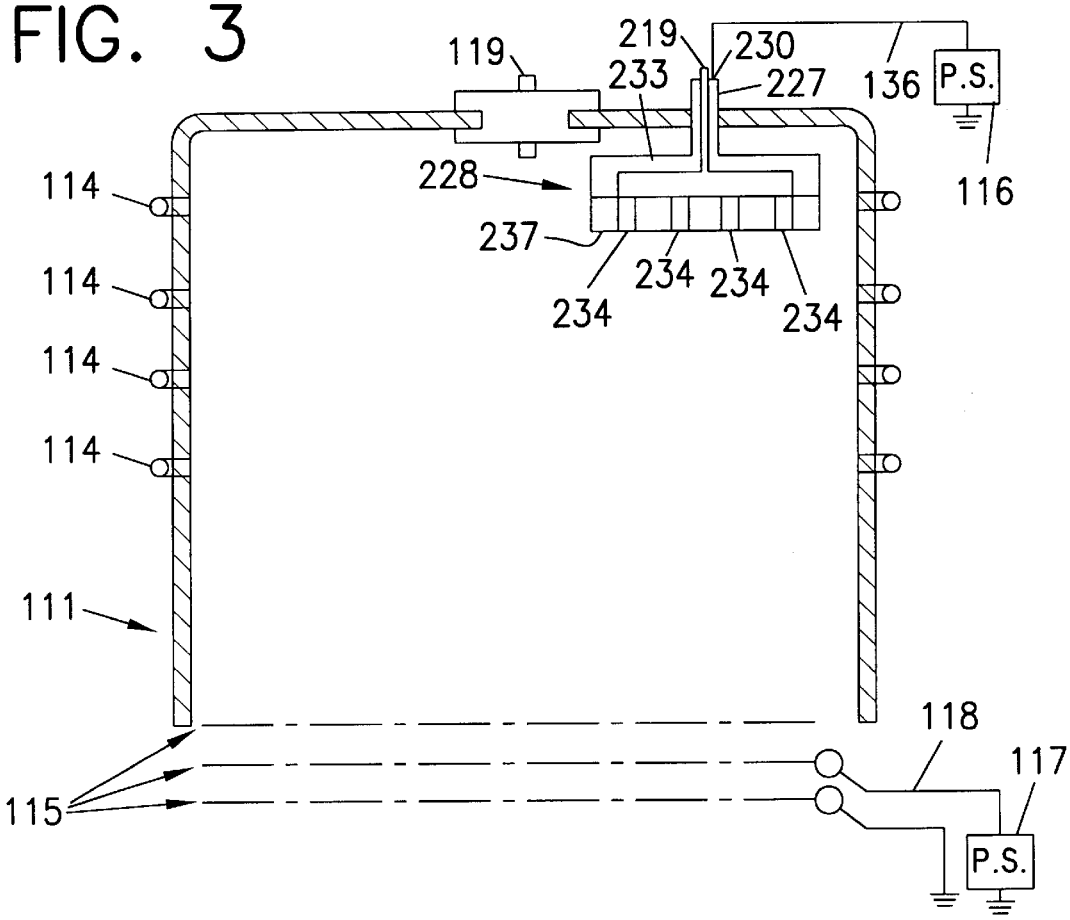
FIG. 3 is a schematic diagram illustrating a charged particle source in accordance with a second embodiment of the invention.

Referring to FIG. 3, there is illustrated an alternate embodiment of the invention that is very similar to that shown in FIG. 2 except for the type of electrode assembly employed. Accordingly, for the sake of simplicity and to avoid repetition only the structure of the electrode assembly will be described in detail. Elements illustrated in FIG. 3 that are the same as those illustrated in FIG. 2 bear the same reference numerals as those same elements in FIG. 2.

As shown in FIG. 3, an electrode assembly 228 is disposed at one end of metallic electrode support member 227, which is preferably hollow. Electrode assembly 228 includes an active electrode 233 and a surface plate 237 containing a plurality of cavities 234. The electrode 233 is electrically connected to support member 227 which is connected to a high voltage power supply 116 via conductor 136 and contact 230. In a preferred embodiment, a gas, preferably an inert gas or a nonreactive, un-ionized precursor gas is introduced to the interior of the electrode through channel 219 and the center of electrode support 227 to the gas plenum 240, where it is redistributed and then passes through cavities 234 into the plasma vessel. This gas, by adsorbing on the inner surface of the electrode 233*a* and colliding with particles entering the cavities 234 from the plasma vessel, further extends the operational lifetime of the electrode. If gas is not used, the cavities 234 can be formed directly in the electrode 233.

Figure 3B:
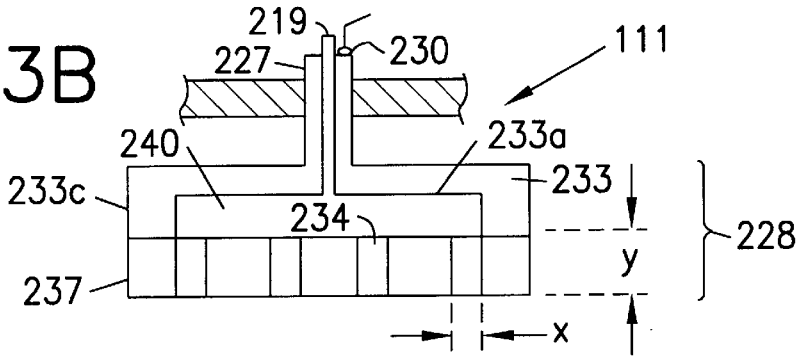
FIG. 3B is a cross-sectional view of the extraction electrode shown in FIG. 3.
Figure 3C:
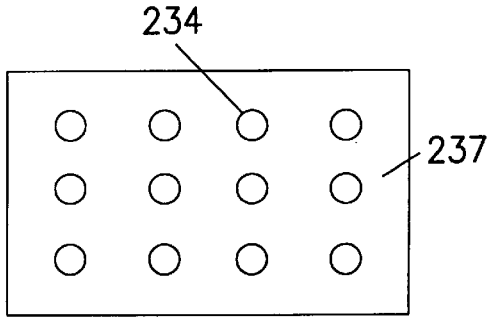
FIG. 3C is a schematic illustration in plan of the extraction electrode shown in FIG. 3.

The geometry of cavities 234 is shown in FIG. 3B. The diameter of the cavity, also generally referred to herein as the aperture size, is shown as dimension "x." The dimension "y" is the maximum depth of the cavity. The "aspect ratio" of the cavity is defined as the ratio of y/x.

The basic concept of this embodiment of the invention is to provide a "hidden" electrode area inside the cavities 234 to inhibit deposition of high resistivity precipitates on the electrode inside the cavities. Such deposits may originate outside of the cavity or may be generated directly by the plasma maintained inside the cavity. Deposits of the first type are minimized because only a small portion of the flux of high resistivity particles in the plasma vessel moving toward the electrode will have trajectories allowing them to traverse the cavity without first hitting and sticking on the cavity walls. The coating rate of plasma-generated particles on the walls of cavities decreases rapidly as the aspect ratio of the cavity increases over 1:1 and is greatly reduced for aspect ratios of 5:1 or greater.

Deposition inside the cavities from local plasma processes are also reduced due to the fact that the plasma inside a cavity has a lower density than the bulk plasma. A plasma can be extinguished inside cavities with very small apertures about a Debye length (about 0.1 mm), or greatly reduced for cavities with very high aspect ratios (greater than about 10:1). However, such plasma damping can also inhibit electron flow to the electrode. It can be shown that the electron current "$I_{e,a}$" collected on an anode inside an ion source is in fact directly proportional to the plasma density as given by the following:

$$I_{e,a}=0.25n_{p,a}eA_a\sqrt{(8kT_{e/\pi m_e})}\exp(eU_s/kT_e)$$

where "e"=the electron charge, k=Boltzmann's constant, $m_e$=the electron mass, $n_{p,a}$=the electron (plasma) density in the vicinity of the anode, $T_e$=the electron temperature of the plasma, $U_s$ is the potential difference between the electrode and the plasma (usually negative), and $A_c$ is the area of the electrode. This equation is based on the usually reasonable assumption of a Maxwellian electrons distribution in the plasma.

Considering the limitation on the electron current, it is not obvious a priori that the geometries of the cavities can be optimized to significantly reduce the deposition rate of high resistivity precipitates on the electrode without destroying its electron collection function. We have however experimentally determined that there exist reasonable cavity geometries and electrode dimensions for which the buildup of high resistivity deposits on the electrode is almost negligible, while electron flow to the anode is unimpeded. These experiments were initially conducted with another embodiment of the "hidden" electrode concept, the "stacked plate" electrode, shown in FIG. 6, which is described below.

Despite the fact that the optimum cavity geometries cannot be precisely predicted, certain general limits can be noted. First, the opening of the cavity "x" (FIG. 3B) should be greater than the Debye length of the plasma and at least on the order of the plasma sheath thickness (which is usually several times the Debye length) for electrons to pass through the cavity. These minimum dimensions are functions of the plasma conditions but are typically on the order of about 0.1 to about 0.5 mm. Second, the aspect ratio of the cavity should be at least about 2:1 to provide a significant level of protection from deposition directly from the bulk plasma.

Another consideration for the design of the electrode is the provision for sufficient effective area for electron current collection. To maintain quasi-neutrality of the plasma, the electron current to the anode $I_{e,a}$ should balance the beam current $I_b$ plus the ion current to the anode $I_{i,a}$, i.e. $I_{e,a}=I_b+$ Ii,a.

The electron current to the anode is a function of the plasma parameters $n_{p,a}$, $A_a$, $T_e$, and $U_s$ as given by:

$$I_{i,a}=n_{p,a}q_iA_a\sqrt{(kT_{e/m_i})}$$

where $q_i$ is the ion charge and $m_i$ is the mass of the ion.

Similarly the maximum beam current (current at saturation plasma current density) can be expressed as:

$$I_b=n_pq_iA_g\sqrt{(kT_{e/m_i})}$$

where $n_p$ is the density of the plasma at ion extraction electrode and $A_g$ is the total area of ion beam extraction.

Stable conventional plasma systems are characterized by negative values of the sheath potential drop, $U_s$ at all surfaces in contact with the plasma. Applying this condition to the anode and combining the equations given above, we find that there is a general minimum anode area for ion source operation at maximum beam current which is approximately:

$$A_a(\min)=A_g(qn_p/en_{p,a})\sqrt{(2\pi m_{e/(m_i)})}$$

Thus the ratio $n_p/n_{p,a}$ will have a significant impact on the required anode area. For an anode of the prior art, e.g. the screen grid anode shown in FIG. 1, this ratio will be equal or close to unity, whereas for a cavity electrode of the present invention, the plasma density inside the cavity will be significantly decreased from the bulk plasma density and the ration $n_p/n_{p,a}$ will be larger than one. Therefore, more anode area is employed to sustain the same source operation. For example, a reasonable value may be at least $n_p/n_{p,a}=7$.

For a singly charged methane ion plasma, for example, this equation can be reduced to:

$$A_a(\min)=(n_p/n_{p,a})A_g/68$$

For the case of a 30 cm diameter ion source with a 50% open area for ion extraction $A_g=350\ cm^2$. Operated with a singly charged methane ion plasma, we calculate the anode area should be greater than about 5 $cm^2$ (for $n_p/n_{p,a}-1$) and preferably greater than 35 $cm^2$ (for $n_p/n_{p,a}=7$).

For the embodiment of the "hidden electrode" shown in FIG. 3, we consider a number "$N_c$" of cylindrical cavities of radius "r." The number of cavities is related to the total effective anode area by: $N_c=A_s/(\pi r^2)$.

At the beginning of the source operation, the area of the anode in FIG. 3 is relatively large as the entire conductive surface of the anode assembly 228 participates in electron collection. However, after some operating time, the surface, including the superficial area of the cavities, will become coated with high resistivity deposits and the effective anode area will be decreased. This remaining conductive area is the area of particular interest. For a quantitative example, we will assume that the cavity walls are coated but the bottom of the cavities remain conductive. This is a reasonably conservative assumption for a cavity with an aspect ratio of about 3:1. In this example, we also assume a cavity diameter of x=5 mm. Each cavity has an anode area of about 0.2 $cm^2$. To accommodate, for example, the preferred anode area dimensions described above, we calculate the minimum number of cavities to be between about 25 to 175 cavities. Increased current capacity can be obtained by increasing the number of cavities.

Figure 4:
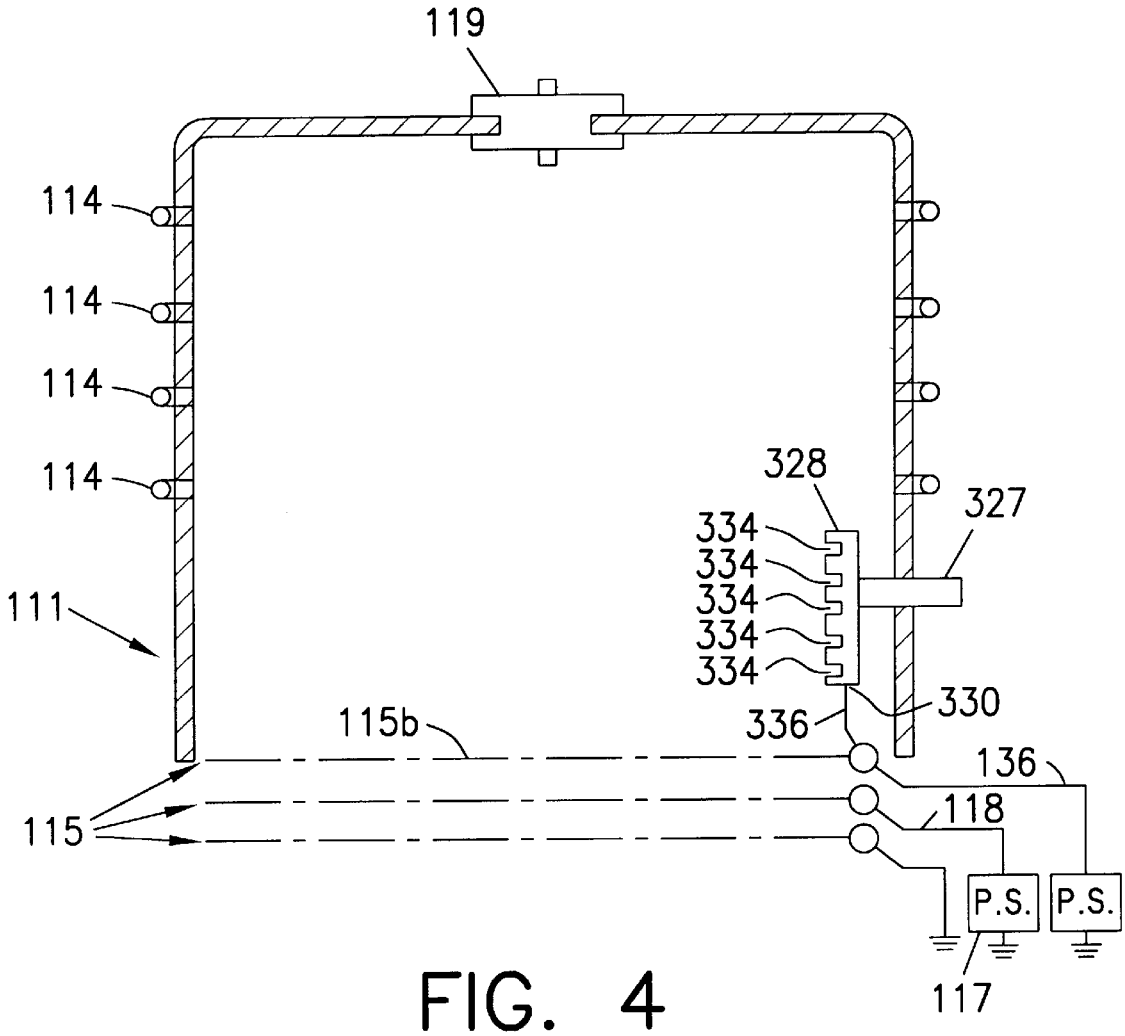
FIG. 4 is a schematic diagram of another embodiment of the invention, showing an alternate form of extraction electrode.
Figure 4B:
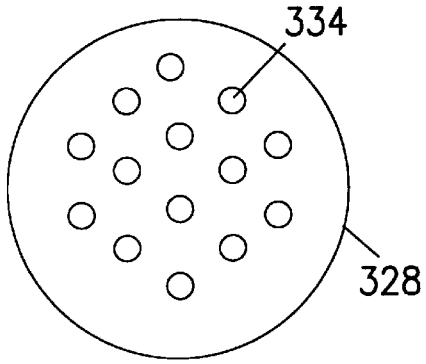
FIG. 4B is a schematic illustration in plan of the extraction electrode shown in FIG. 4.

FIG. 4 illustrates an alternate version of a "hidden electrode" with formed cavities which is very similar to that shown in FIG. 3 except there are no special external electrical connections.

Figure 4C:
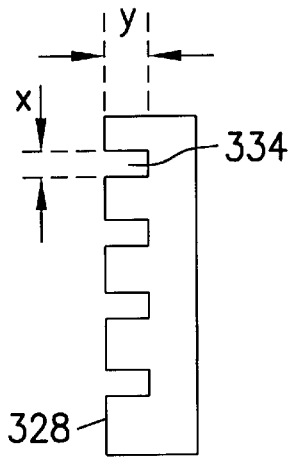
FIG. 4C is a magnified cross-sectional view of the extraction electrode shown in FIG. 4.

As shown in FIG. 4, a metallic electrode 328 is disposed at one end of electrode support member 327. The electrode 328 contains a plurality of cavities 334. It is connected through contact 330 and lead 336 to an electrical contact on screen grid 115*b*, which is also connected to the positive high voltage power supply 116 via connector 136. If grid 115*b* is conductive, the anode function will be shared by grid 115*b* and electrode 328. However, during operation, the unprotected grid 115*b* and outside of electrode 328 may become completely coated with high resistivity deposits. In such a case, or if the grid surface is deliberately rendered nonconductive, only the surfaces inside the cavities of electrode 328 will active perform as the anode. For simplicity in illustration only, the electrode design 328 is shown in FIG. 4 without the provision for gas flow described in FIG. 3. It will be understood that gas flow may be provided as illustrated in FIG. 3. The dimensions "x" and "y" in FIG. 4C have the same significance as described for the embodiment of the invention shown in FIG. 3B, and the preferred cavity geometries and number of cavities are the same as described for that case.

Figure 5:
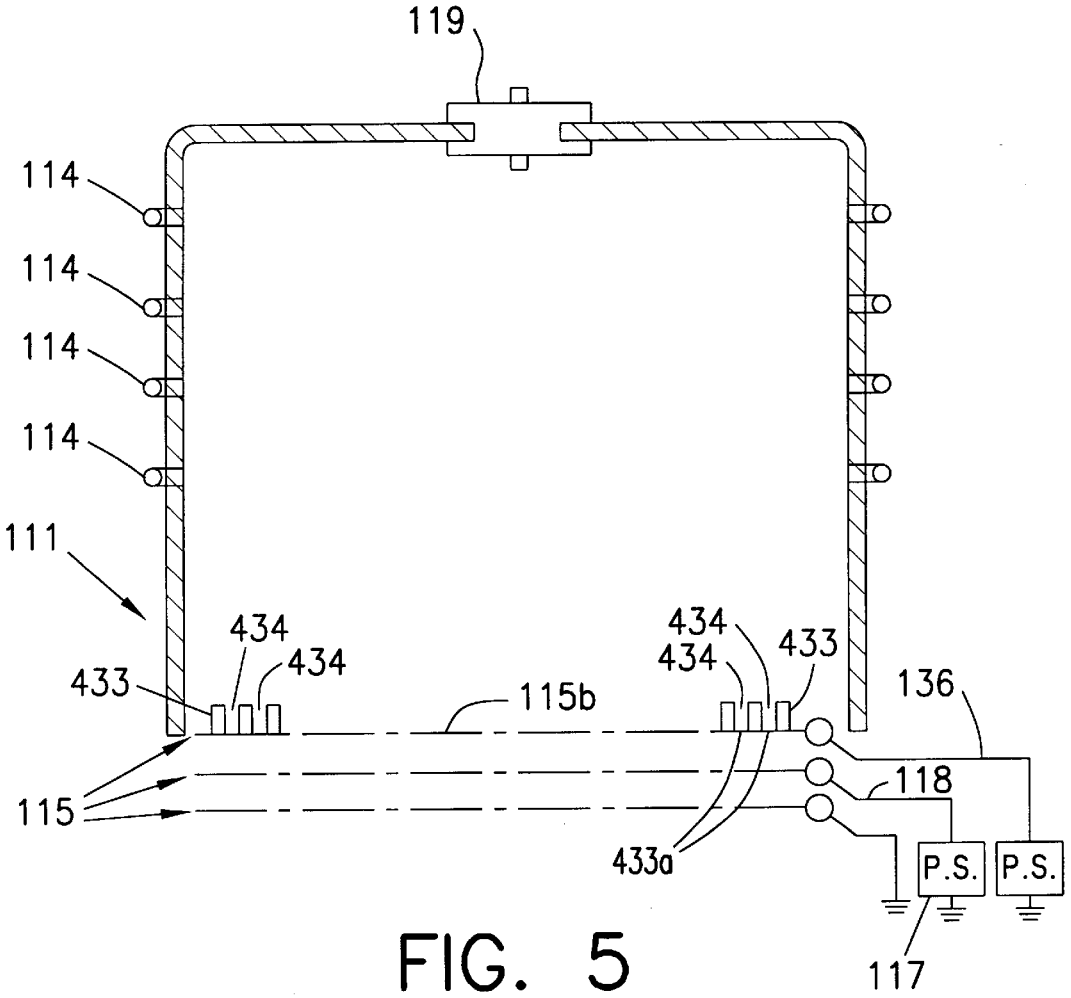
FIG. 5 is a schematic diagram of another embodiment of the invention, showing an alternate form of extraction electrode.
Figure 5B:
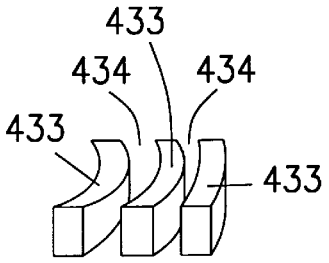
FIG. 5B is a 3D perspective view of electrode structure shown in FIG. 5.

Referring to FIG. 5, there is illustrated another embodiment of the invention that employs the concept of a "hidden electrode". In this embodiment, the cavities 434 of the hidden electrode are formed on the surface of the grid 115*b* itself. As shown in FIG. 5B, the cavities are formed between concentric rings 433 arranged at the periphery of the grid. These rings can be formed from the grid itself as part of the grid fabrication process by methods known to those skilled in the art, or may be formed separately and mechanically attached to the fabricated grid plate. The grid 115*b* is connected to the positive high voltage supply 116 by the conductor 136.

Figure 5C:
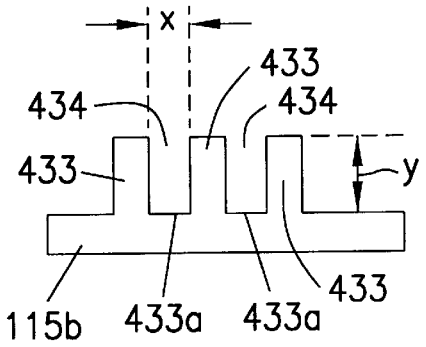
FIG. 5C is a cross-sectional view of the extraction electrode shown in FIG. 5.

The dimensions "x", the aperture size or diameter, and "y", the depth of the cavity, of the "ring cavity" shown in FIG. 5C are exactly analogous to the "x" and "y" dimensions of the cylindrical cavities defined in reference to FIG. 3B. Again, the aspect ratio y/x of the cavity should be at least about 2:1 and is preferably at least about 3:1.

We consider a set of two rings of diameter 20 cm (appropriate to a 6" diameter charged particle source) with spacing of x=5 mm. Assuming that only the bottom of the cavity is actively collecting electrons (for the same reasons discussed above with respect to FIG. 3), we calculate the total effective anode area to be 31 $cm^2$, which is more than sufficient for this illustrative ion source.

Figure 6:
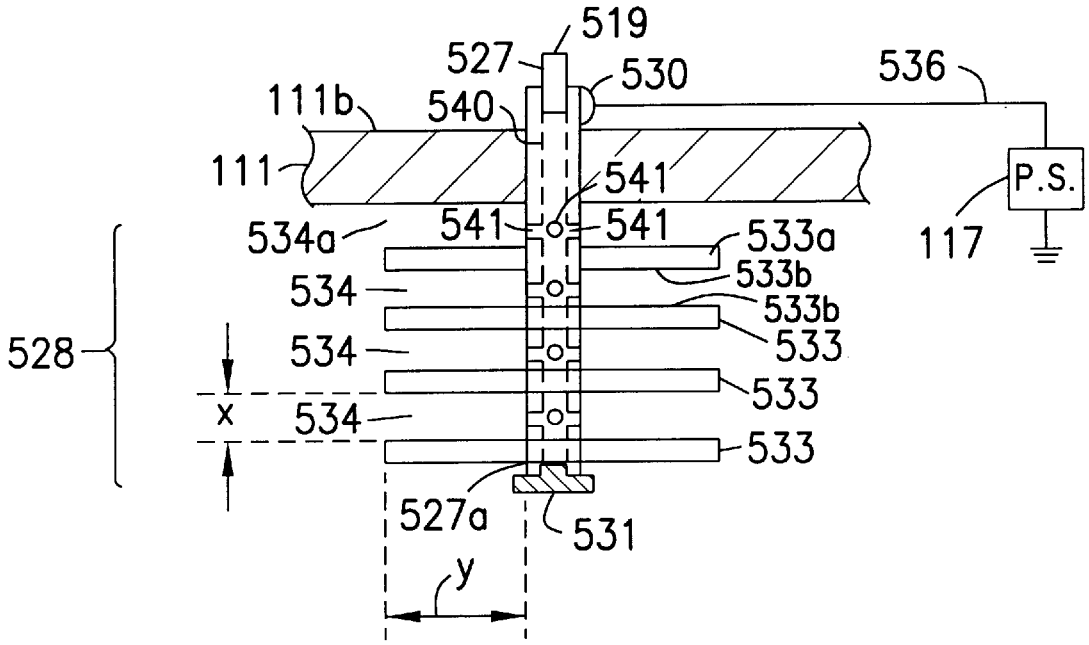
FIG. 6 is a schematic diagram of another embodiment of the invention, showing an alternate form of extraction electrode.

Referring to FIG. 6, there is illustrated another embodiment of the concept of the "hidden electrode". As shown in the drawing, an electrode assembly 528 is disposed adjacent to end 527*a* of metallic electrode support member 527. To avoid unnecessary redundancy, the other elements of the invention comprising the charged particle source, namely the RF coils, the grid assembly, the suppresser power supply, etc. which are shown in FIGS. 2–4 are not shown in FIG. 5 or subsequent electrode embodiments. As in the previous embodiments of the invention, the electrode support member 527 is mounted in the interior 111*a* of the plasma vessel 111, which is partially shown in the drawing in FIG. 6 for the sake of clarity.

Electrode assembly 528 in FIG. 6 includes a plurality of spaced apart metallic plate members 533 which define the cavities 534. Cavity 534*a* is formed between the uppermost plate 533*a* and the interior of the plasma vessel wall 111*b* or other surface which is situated between the wall 111 and the plate 533*a*. Cavities 534 have a geometry which prevents the deposition of high resistivity precipitates on the inner surfaces of the plates 533*b* and the support member 527. These parts form the active part of the electrode as they are electrically connected to the power supply 116 via the conductor 536 which makes electrical contact with the support member 527 at 530. The dimensions "x", the aperture size or spacing between the plates and "y", the depth of the cavity, as shown in FIG. 6 are analogous to the "x" and "y" dimensions indicated in FIG. 3. For the same reasons which were given in the description of the embodiment of the invention illustrated in that drawing, the minimum aperture dimension "x" is typically on the order of about 0.1 to about 0.5 mm and the aspect ratio of the cavity y/x should be at least about 2:1 and is preferably at least about 3:1. In order to maximize the available active "hidden" electrode area, the dimensions of cavity 534*a* preferably also meet this criteria.

Figure 6B:
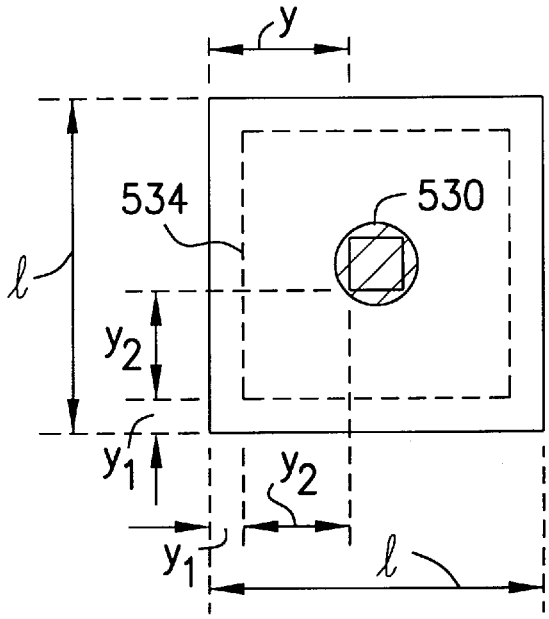
FIG. 6B is a schematic illustration in plan of the extraction electrode shown in FIG. 6.

Preferably, the dimensions of the electrode provide a minimum effective "hidden" anode area, the lower limit of which may be estimated as follows. First, one should exclude from the effective anode area calculation a zone around the perimeter of the stacked plates which is represented by the dimension "y1" measured from the outside edge of the plate, as shown in FIG. 6B. This zone is not protected from the bulk plasma and will become coated with high resistivity precipitates. The effective anode area can be represented as an zone of width "y2", as shown in FIG. 6B. "y1" may be about 3 times the aperture dimension "x." For example, assuming that the spacing between the plates is between 1 and 2 mm, it is reasonable to assume y1=5 mm. For a stack of rectangular plates of length l=2 mm, y2=0.5 mm, and the anode area per each hidden surface is 7 $cm^2$. Thus a stack of 3 plates having 4 hidden surfaces has a total anode surface of 28 $cm^2$, which is in the range of about 5 $cm^2$ to about 30 cm* preferred for a 30 cm methane ion beam source as described in reference to FIG. 3. Increased current capacity can be obtained by increasing the length or, preferably, the number of plates 533.

In a preferred embodiment of this stacked plate electrode, a gas, preferably an inert gas or a nonreactive, unionized precursor gas is introduced to the interior of the electrode and flows through the cavities 534. In the illustration shown in FIG. 6, support member 527 is hollow but closed off at end 527*a* by plug 530. Gas is introduced from inlet 519 to the interior 540 of the support member 527, from where it is distributed between the plates 533 through the holes 541 which have been formed in the support member 527. The benefit of flowing gas through the cavities of a hidden electrode is discussed in the description of FIG. 3 given above.

Figure 7:
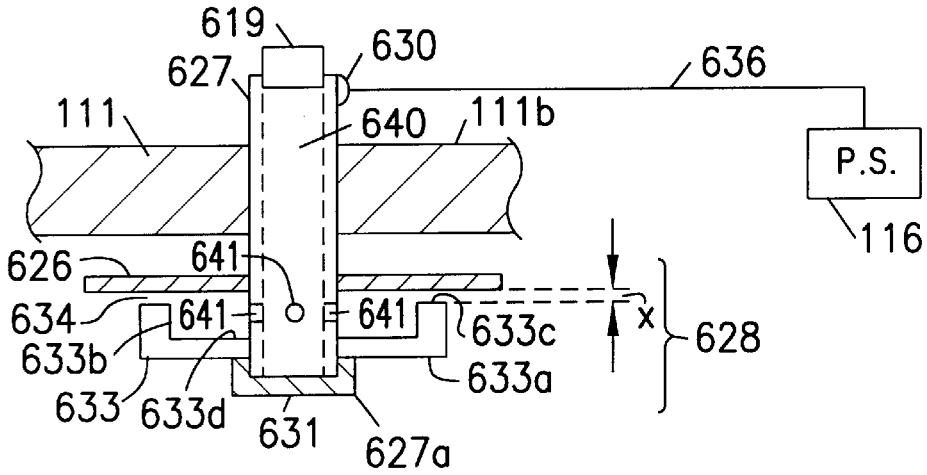
FIG. 7 is a schematic diagram of another embodiment of the invention, showing an alternate form of extraction electrode.

FIG. 7 is yet another embodiment of a hidden electrode in accordance with the invention. A metallic electrode support member 627 extends through surface 111*b* of the plasma vessel and has an end portion 627*a* disposed in vessel 111. Preferably, support member 627 is hollow. Electrode assembly 628 is disposed at end 627*a* of support member 627. It comprises a metallic electrode tray 633 which is in electrical contact with this member and a plate 626 or generally flat surface. As illustrated, tray 633 includes a base portion 633*a* and an upright wall portion 633*b* defining an interior. The gap between the face 633*c* of the electrode wall 633*b* and the surface 626 forms a cavity 634 protecting the interior 633*d* of the electrode from deposition by high resistivity deposits.

Figure 7B:
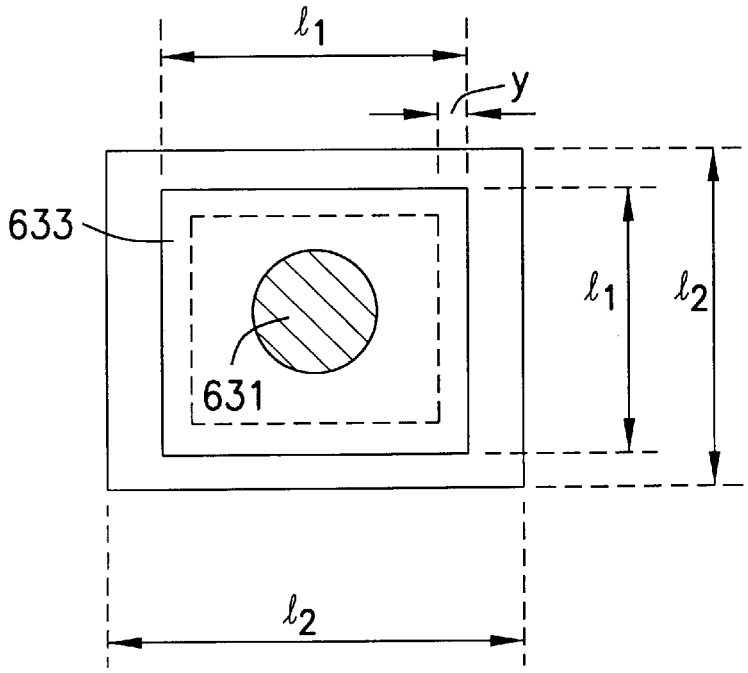
FIG. 7B is a schematic illustration in plan of the extraction electrode shown in FIG. 7.

The dimensions "x" and "y" of the cavity shown in FIG. 7 are directly analogous to the "x" and "y" dimensions shown in FIG. 3. The minimum aperture dimension "x" is typically on the order of about 0.1 to about 0.5 mm and the aspect ratio of the cavity should be at least about 2:1 and is preferably at least about 3:1. To determine a practical minimum dimension for the tray per A of beam current it may be assumed that the effective surface area of the electrode is the inside area of the tray 633*d*, which is, for a rectangular tray as shown in FIG. 7B the square of dimension "$l_1$" (ignoring the small area of the support 627). Thus a tray of $l_1$=4 cm has an electrode area of 16 $cm^2$. This is sufficient for a 30 cm methane ion source with a plasma density three times less than the bulk plasma in accordance with the above discussion concerning FIG. 3. Increased current capacity can be obtained by increasing the size of the tray or, preferably, by stacking several trays together.

In a preferred embodiment of the electrode shown in FIG. 7, an inert gas or a nonreactive, unionized precursor gas is introduced to the interior of the electrode and flows through the cavities 634. In the illustration shown in FIG. 7, support member 627 is hollow but closed off at end 627*a* by plug 631. Gas is introduced from inlet 619 to the interior 640 of the support member 627, from where it is distributed in the interior of the electrode through the holes 641 which have been formed in the support member 627. The benefit of flowing gas through the cavities of a hidden electrode is discussed in the description of FIG. 3 given above. The surface 626 may simply be the interior wall of plasma vessel 111 or other convenient surface, such as a gas baffle.

Figure 8:
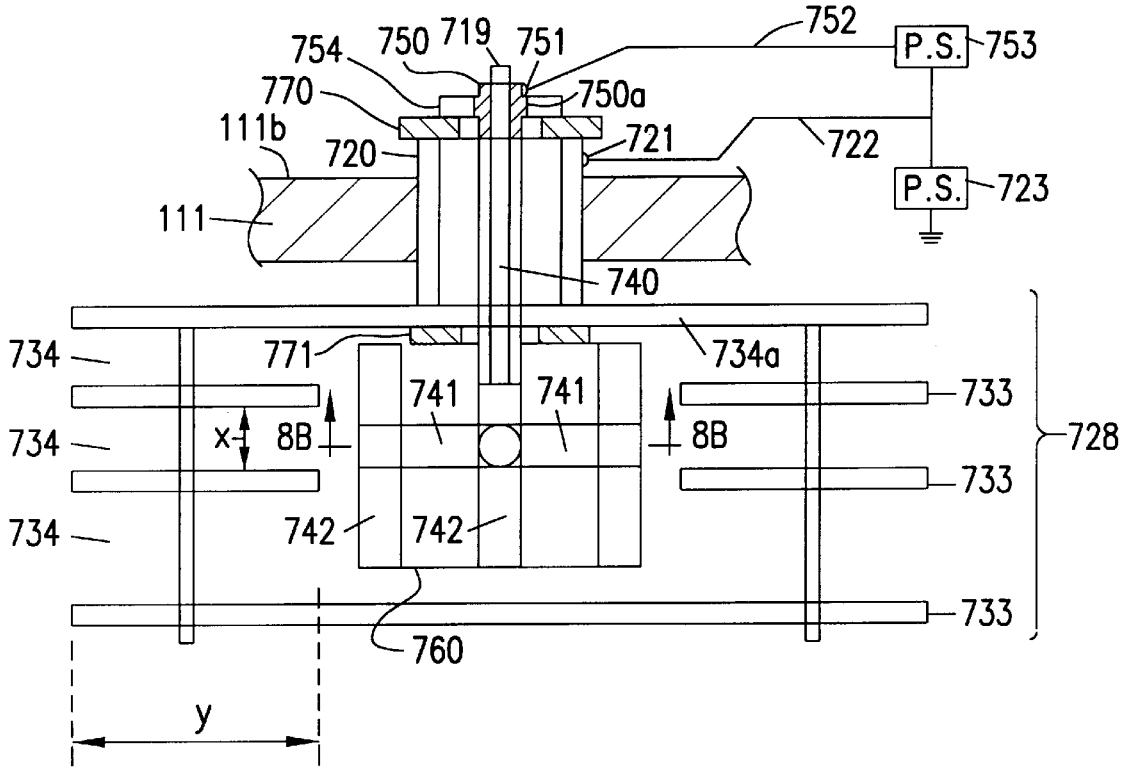
FIG. 8 is a schematic diagram of another embodiment of the invention, showing an alternate form of extraction electrode.
Figure 8B:
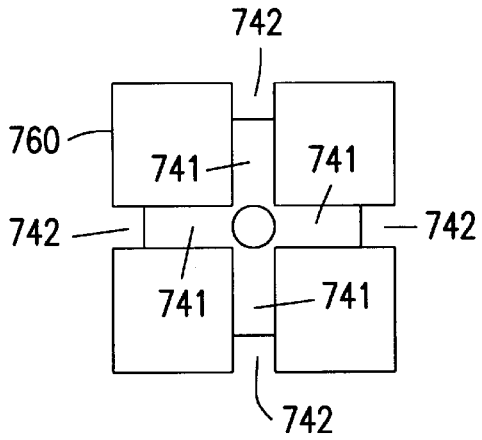
FIG. 8B is a cross-sectional view of the extraction electrode shown in FIG. 8.

FIG. 8 is a modified version of the hidden electrode illustrated in FIG. 6 in which the electrode is situated inside of a plurality of stacked plates, electrically isolated from these plates, and maintained at a higher positive potential than the plates. The electrode assembly 728 is situated in the interior lla of plasma vessel 111. A metallic assembly support member 720 extends through surface 111*b* of the plasma vessel and is connected inside the plasma vessel to a plurality of stacked plates 733 which define cavities 734. The metallic electrode 760 is connected to metallic support member 751, which is threaded on its exterior diameter at outside end 750*a* and mounted on the assembly support member 720 by nut 754 and spacers 770 and 771. Spacers 770 and 771 are electrical insulators made of appropriate material, such as ceramic.

Cavities 734 have a geometry which prevents the deposition of high resistivity precipitates on the inner surfaces of the electrode or conductive precipitates on the insulator 771, which is also hidden from any sputtered material generated inside the electrode by the cavity 734*a*. The electrode 760 is electrically connected to the power supply 753 via the support member 750, contact 751, and conductor 752. The negative end of this power supply is connected to the positive end of power supply 723, which is also directly connected to the stacked plates 733 via the support member 720, contact 721, and conductor 722.

The dimensions "x", the aperture size or spacing between the plates, and "y", the depth of the cavity, as shown in FIG. 8 are directly analogous to the "x" and "y" dimensions indicated in FIG. 6.

This embodiment has the advantage that the higher positive potential of the electrode component will actively attract electrons from the plasma. Thus electron current to the electrode can be controlled by adjusting the voltage of power supply 753.

In a preferred embodiment of the electrode shown in FIG. 8, an inert gas or a nonreactive, un-ionized precursor gas is introduced to the interior of the electrode and flows through the cavities 734. In the illustration shown in FIG. 8, support member 750 is hollow. Gas is introduced from inlet 719 to the interior 740 of the support member 750, from where it is distributed in the interior of the electrode 760 through the channels 741. It is then redistributed among the multiple cavities 740 by the gas channels 742. The benefit of flowing gas through the cavities of a hidden electrode is discussed in the description of FIG. 3 given above.

Figure 9:
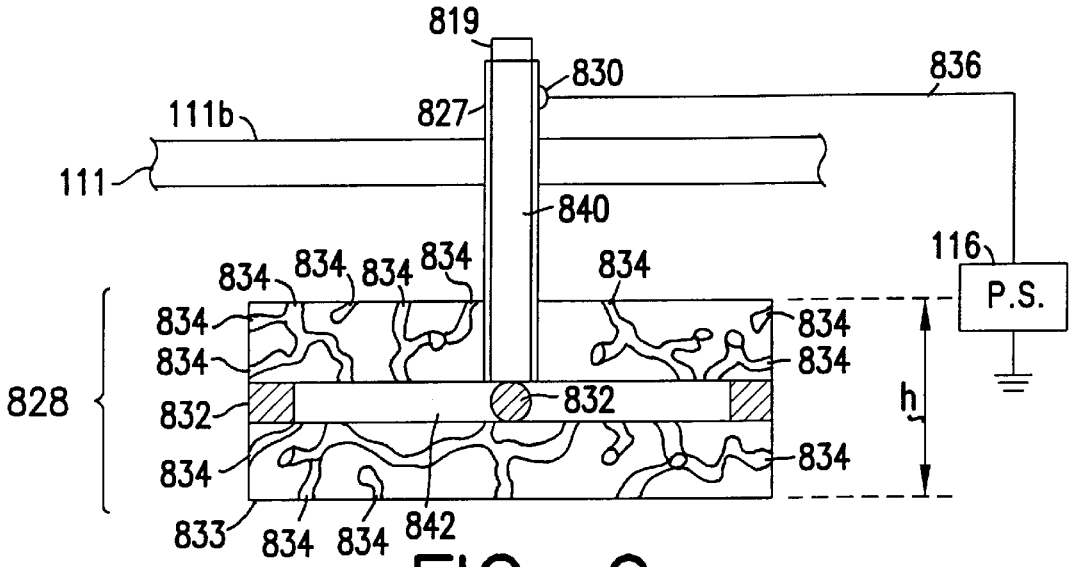
FIG. 9 is a schematic diagram of another embodiment of the invention, showing an alternate form of extraction electrode.
Figure 9B:
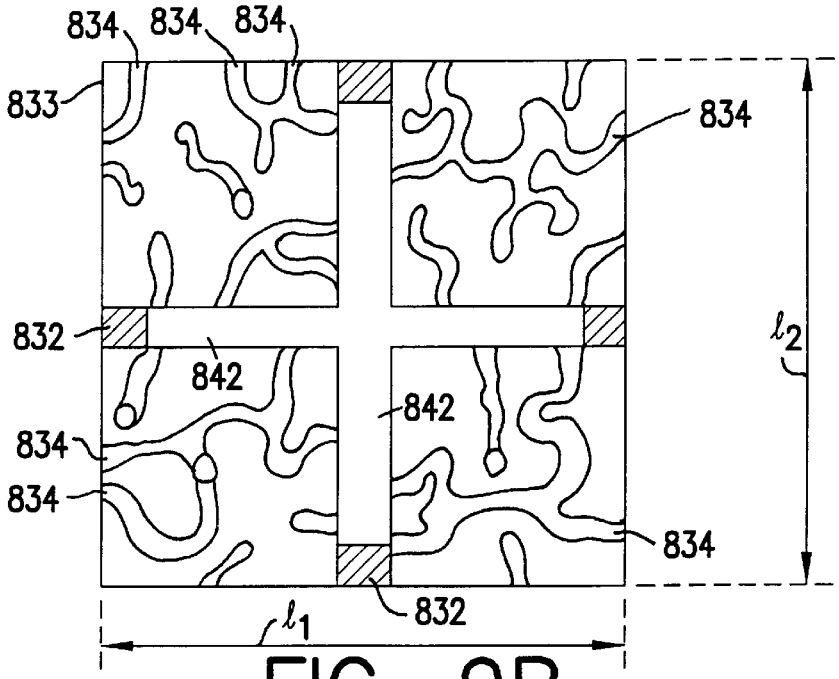
FIG. 9B is a cross-sectional view of the extraction electrode shown in FIG. 9.
Figure 9C:
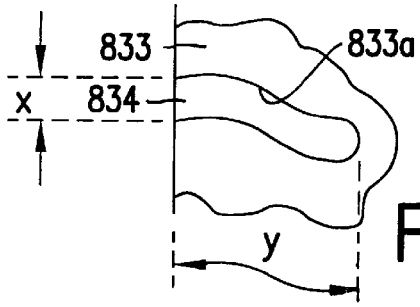
FIG. 9C is a magnified cross-sectional view of the cavity structure of the extraction electrode shown in FIG. 9.

FIG. 9 is another embodiment of a hidden electrode in accordance with the invention. A metallic electrode support member 827 extends through surface 111*b* of the plasma vessel and inside the vessel is connected mechanically and electrically to a conductive porous electrode block 833, such as for example sintered molybdenum. Preferably, support member 827 is hollow. The electrode and support member 827 are connected to the positive high voltage power supply 116 via contact 830 and conductor 836. The pores in the electrode form a series of cavities 834 analogous to the cavities shown in FIG. 3. Thus the inner surfaces of the many of the pores 833*a*, shown in FIG. 9C, are not deposited with high resistivity precipitates because they are hidden from those generated in the body of the plasma and narrow pores do not support a significant level of plasma internally that could generate high resistivity precipitates. The dimensions "x" and "y" of the pore shown in FIG. 9C are analogous to the "x" and "y" dimensions of the cavity shown in FIG. 3. For the same reasons given in the description of the embodiment of the invention illustrated in that drawing, the preferred minimum aperture size (pore diameter) "x" is on the order of about 0.1 to about 0.5 mm and the aspect ratio of the pore (cavity) should be at least about 2:1 and is preferably at least about 3:1.

Preferably, the dimensions of the electrode block 833 provide a minimum effective "hidden" electrode area consistent with the beam current requirements of the charged particle source. Although many different pore sizes may be observed in the porous material, we preferably consider only those pores with geometries (such as aspect ratios between about 2:1 and about 5:1) which allow electrons to enter the pore but inhibit coating of the entire porous channel with high resistivity deposits. The effective electrode area of each pore may on average be defined as the area of the aperture. Assuming, for example, a uniform pore size diameter of 5 mm and a 50% pore density at the surface, a quantity of 75 surface pores would be employed to obtain an anode area of about 30 $cm^2$. Such an area is reasonable for a 30 cm methane ion source as described above in reference to FIG. 3. For a porous cube 833 with dimensions of $s=h=l_1=l_2$, the surface area is equal to 6 $s^2$, giving a minimum dimension $l=\sqrt{(30/6)}$=about 2.2 cm.

In a preferred embodiment of the electrode shown in FIG. 9, an inert gas or an unionized precursor gas, such as methane, is introduced to the interior of the electrode and flows through the pores 834. In the illustration shown in FIG. 9, support member 927 is hollow. Gas is introduced from inlet 819 to the interior 840 of the support member 827, from where it is distributed in the interior of the electrode through channels 842. Each of these channels is closed at the end with plugs 832 such that the gas is forced to flow out the pores connecting cavities 834 at the surface of the electrode with the gas channels 842. The benefit of flowing gas through the cavities of a hidden electrode is discussed in the description of FIG. 3 given above.

Figure 10B:
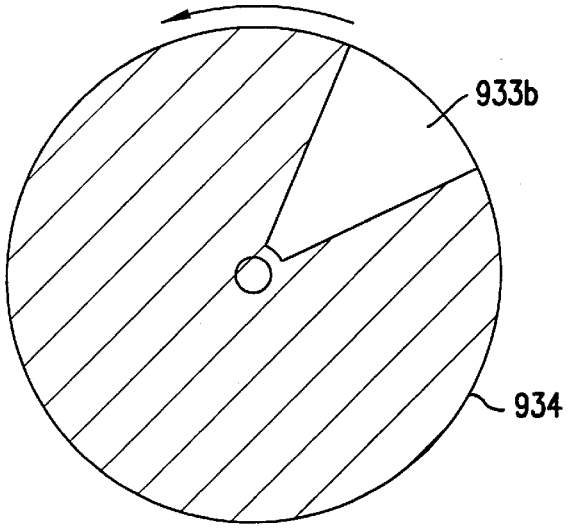
FIG. 10B is a schematic illustration in plan of the extraction electrode shown in FIG. 10.
Figure 10:
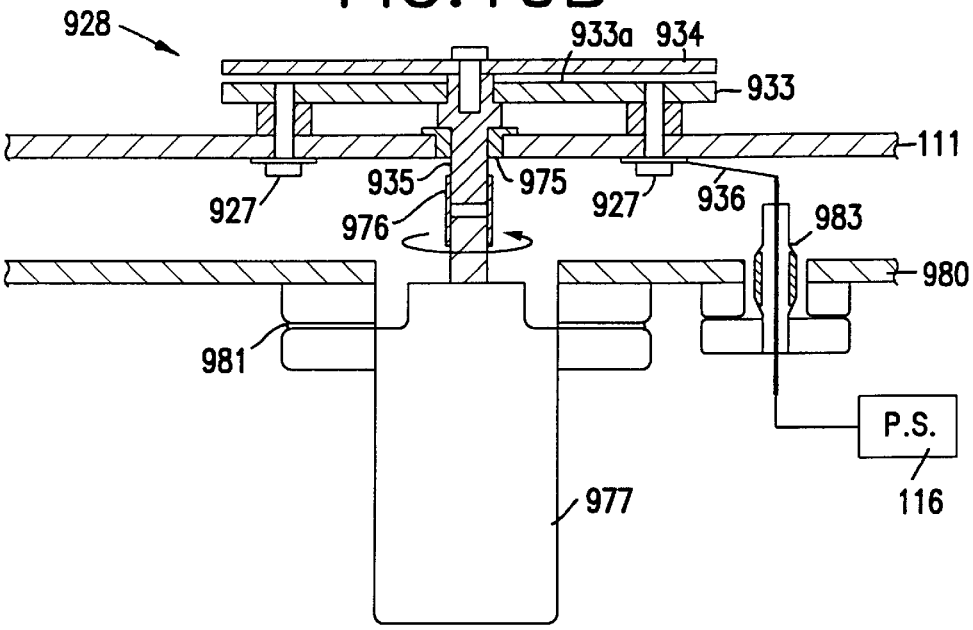
FIG. 10 is a schematic diagram of another embodiment of the invention, showing an alternate form of extraction electrode.
Figure 10C:
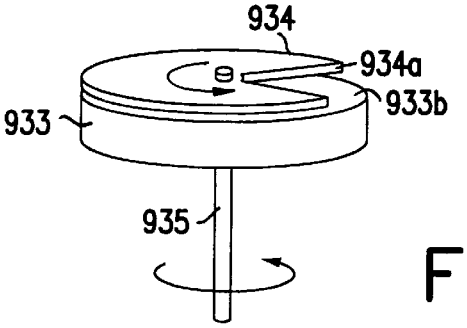
FIG. 10C is a 3-D perspective view of electrode structure shown in FIG. 10.
Figure 11:
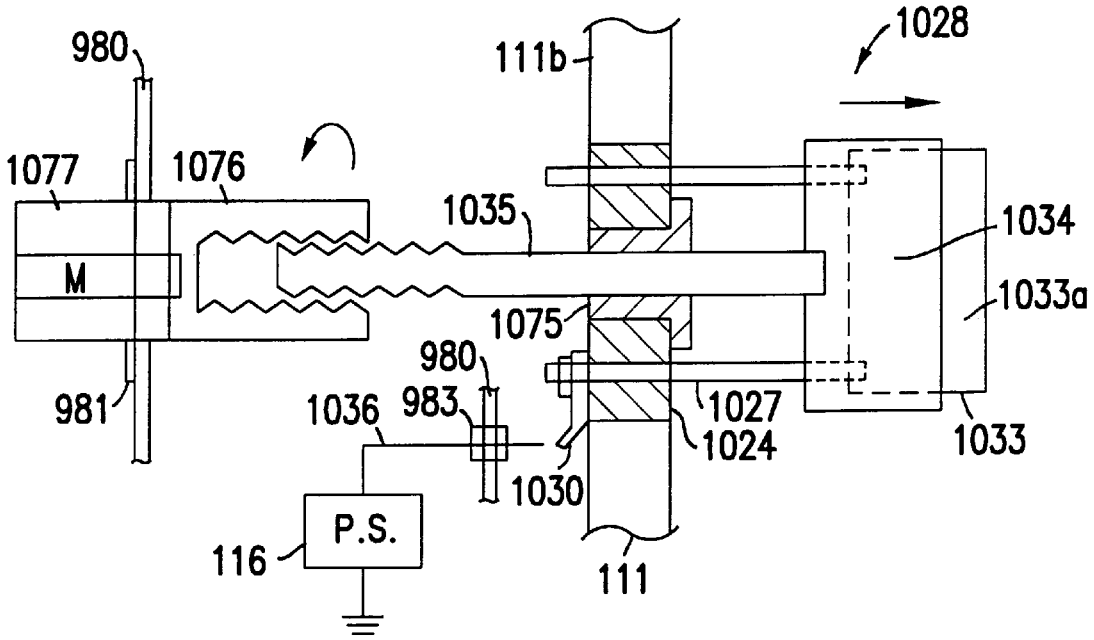
FIG. 11 is a schematic diagram of another embodiment of the invention, showing an alternate form of extraction electrode.
Figure 12:
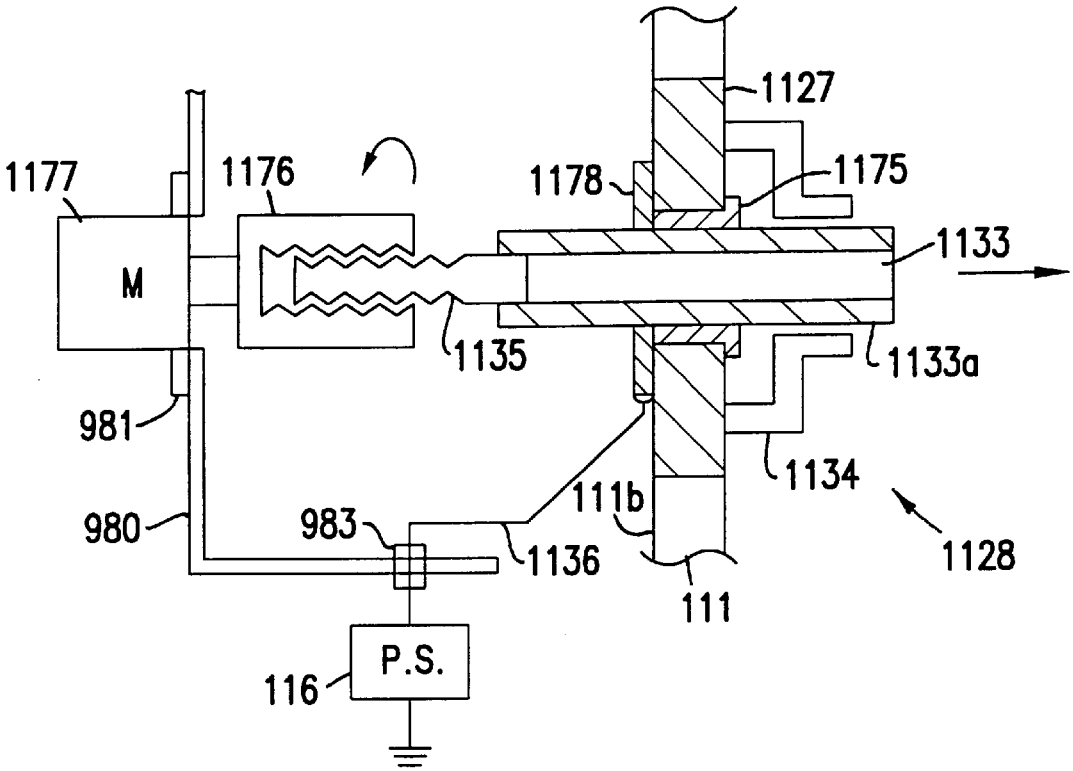
FIG. 12 is a schematic diagram of another embodiment of the invention, showing an alternate form of extraction electrode.
Figure 12B:
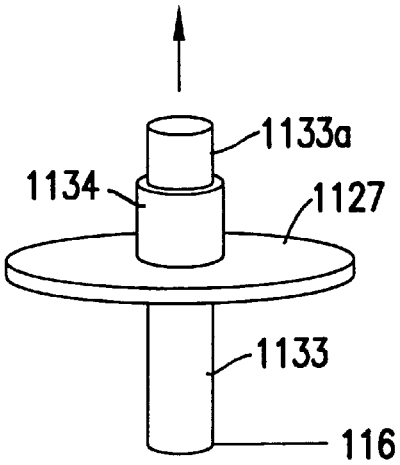
FIG. 12B is a 3D perspective view of electrode structure shown in FIG. 12.

Referring to FIGS. 10–12, there are schematically illustrated particularly configured extraction electrodes which include means for gradually exposing "hidden" areas of the electrode to the plasma. Referring to FIG. 10, the electrode assembly 928 includes a conductive disc or plate member 933 having a surface 933*a* and a rotatable shield member 934 disposed over surface 933*a*, the shield 934 having a cut out portion 934*a* which exposes a portion 933*b* of surface 933*a*. Shield member 934 is mounted on a shaft 935 which communicates through plasma vessel wall 111 by rotational feedthrough 975 and is driven by a motor 977 through electrically insulating coupling 976. As shown in FIG. 10, the motor is mounted on the wall 980 of the process chamber by flange assembly 981 which seals between the reduced pressure of the process chamber and the outside environment. Electrode 933 is supported on the wall of the plasma vessel 111 by metal bolts 927. It is connectable to the beam power supply 116 through the bolts 927 by conductor 936 via high voltage feedthrough 983 mounted on chamber wall 980. The rotational feedthrough 975, high voltage feedthrough 983 and vacuum assembly 981 may be standard vacuum system components well known to those skilled in the art.

During operation of the charged particle source, only surface 933*b* of electrode 933 is exposed to the plasma and resulting precipitates. In prolonged use, shield 934 is rotated so as to expose hidden and uncontaminated portions of electrode surface 933*a*. Such gradual exposure of hidden, uncontaminated portions of the electrode significantly inhibits complete contamination of the electrode, thus, prolonging productive use of the electrode. Although as shown in FIG. 10 shield 934 is rotatably driven it will be understood that electrode 933 may be rotatably driven instead.

Figure 11B:
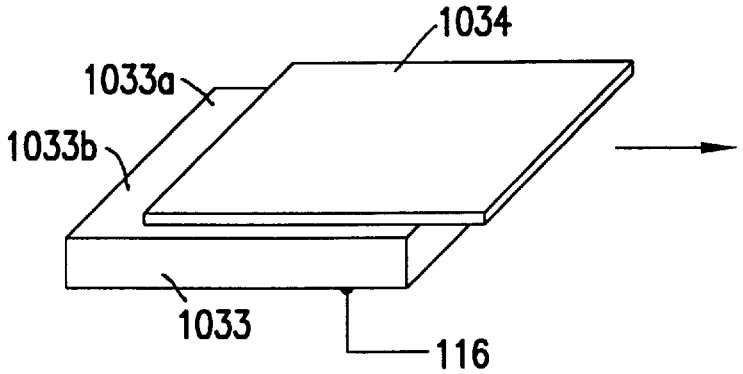
FIG. 11B is a 3-D perspective view of electrode structure shown in FIG. 11.

FIG. 11 schematically illustrates a modification of the electrode assembly shown in FIG. 10. In this drawing, electrode assembly 1028 includes a conductive plate member 1033 having an upper surface 1033*a* and a shield member 1034 disposed over plate member 1033 so as to expose a portion 1033*b* of plate 1033. As shown electrode plate 1033 is connectable to a positive voltage supply 116 through conductor 1036. Both plate 1033 and shield 1034 are shown as being rectangular in plan but other shapes may be employed. Shield member 1034 is mounted on a screw drive shaft 1035 which communicates through plasma vessel wall 111 by linear feedthrough 1075 and is driven by motor 1077 through the electrically insulating screw drive coupling 1076. As shown in FIG. 11B, the motor is mounted on the wall 980 of the process chamber by flange assembly 981. Electrode 1033 is supported on the wall of the plasma vessel 111 by metal bolts 1027. It is connectable to the beam power supply 116 through bolts 1027 by conductor 1036 via high voltage feedthrough 983 mounted on chamber wall 980. The linear feedthrough 1075 may be a standard vacuum system component well known to those skilled in the art.

During operation of the charged particle source additional surface 1033*a* of electrode 1033 is gradually exposed to the plasma and high resistivity precipitates, prolonging productive use of the electrode.

FIG. 12 schematically illustrates a further embodiment of the extraction electrode of the invention which is similar in mechanical operation to that shown in FIG. 11. As shown, electrode assembly 1128 incorporates a support plate 1127 having a cylindrical sheath member 1134 disposed thereon. A cylindrical conductive electrode member 1133 is slidably disposed in sheath 1134 and through support plate 1127. As shown, the assembly is configured such that a portion 1133*a* of the electrode 1133 disposed above sheath 1134 is exposed to the plasma. In accordance with the invention, the apparatus further includes means such as a motorized screw drive, consisting of motor 1177, electrically insulated coupling 1176, and shaft 1135, for slidably moving electrode 633. In operation, this is done so as to gradually expose to the plasma uncontaminated portions of electrode 1133 that were previously completely unexposed to the plasma. The conductive element communicates through plasma vessel wall 111 via a linear feedthrough 1175. As shown, electrode 1133 may be connectable to the beam power supply 116 by the brush contact 1178 via conductor 1137. In the drawing, the motor is mounted on the process chamber wall 980 by flanges assembly 981 and the conductor 1136 is fed through the chamber wall 980 by a high voltage feedthrough 983.

Another aspect of the invention is to provide a charged particle source with means for removing deposited material from the extraction electrode during source operation. For example, this can be achieved mechanically by pressing a portion of the electrode against an abrasive surface and providing means for rotating the electrode relative to the abrasive surface so as to provide a clean conductive surface at all times.

Figure 13:
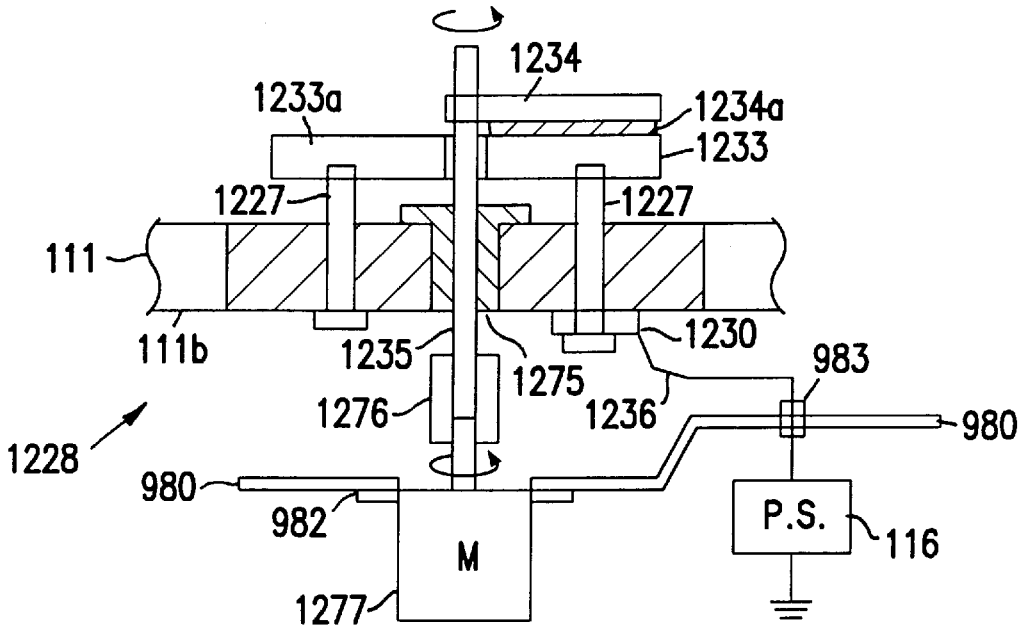
FIG. 13 is a schematic diagram of another embodiment of the invention, showing an alternate form of extraction electrode.
Figure 13B:
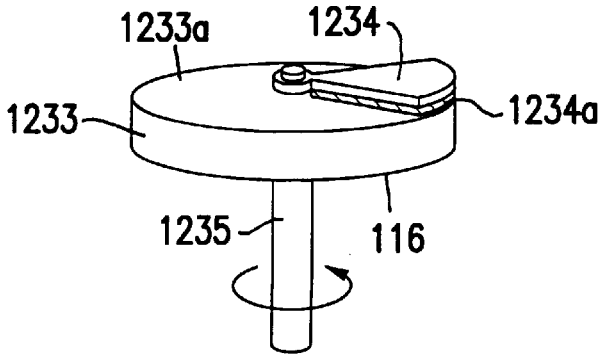
FIG. 13B is a 3D perspective view of electrode structure shown in FIG. 13.

FIG. 13 schematically illustrates an embodiment of the this type of extraction electrode. As illustrated, the electrode assembly 1228 includes a conductive disk member 1233, a rotatable shaft member 1235 associated with disc 1233 and an abrasive member 1234 which has an area smaller than that of electrode surface 1233*a* fixedly engaged with shaft 1235. As shown, shaft 1235 is received through a hole in the center of 1233. A drive member, e.g. a motor 1277 and electrically insulated coupling 1276, engages shaft 1235 to rotate the shaft member 1235 and along with it abrasion member 1234 over surface 1233*a* of the electrode. Abrasion member includes an abrasive surface 1234*a* which contacts surface 1233*a* of conductive electrode. The abrasive surface 1234*a* may be a formed pattern or roughened surface in a metal which is harder than the electrode material, or may contain an abrasive material, for example, diamond or silicon carbide grit embedded in a metal matrix, the matrix metal being for example aluminum, or stainless steel. As shown, electrode 1233 is mounted on the plasma vessel wall 111 by metallic bolts 1227 and is connectable to the beam power supply by a conductor 1237 through the high voltage feedthrough 983 mounted on chamber wall 980. The motor is also mounted on the chamber wall 980 by flange assembly 982.

In operation, shaft 1235 is rotated so that abrasive member 1234 is scraped along surface 1233*a* of the electrode so as to clean off any precipitates deposited by the plasma into surface 1233*a* of the electrode. This cleaning action maintains the conductivity of electrode 1233.

In another aspect of the invention, means is provided to prevent plasma precipitate contamination of the grid assembly of the charged particle source as would otherwise occur as described above relative to the prior art illustrated in FIG. 1.

This is accomplished by providing means to operate the source in a pulse mode. In the first half of a period an electrical field is applied for charged particle extraction, and in the second half of the period the potentials of the grids are set to provide annihilation of charge accumulated on the grid surface coated with resistive precipitates by plasma electrons.

Figure 14:
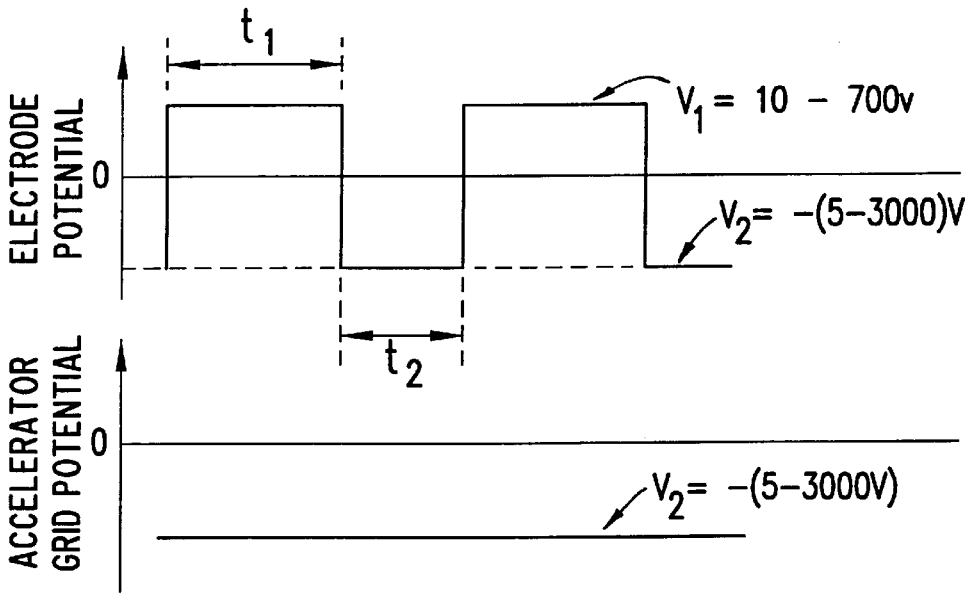
FIG. 14 is a graphical representation illustrating a first pulsed mode of operation of the charged particle source of the invention.

A pulse mode performance in accordance with the invention is represented in FIG. 14 for an ion source. The pulse potential is applied to the electrode used to control the plasma potential, i.e. the anode; during the first part of the period "$\tau_1$" the potential is at $V_1$, the desired value for ion extraction, which is typically between about 10 to about 2000 V. During the second part of the period "$\tau_2$" it equals the potential of the accelerator grid $V_2$. The accelerator grid potential is fixed at the desired value for ion extraction $V_2$, usually between about −5 to about −3000 V. Such a mode of ion extraction allows one during the first part of a period to extract ions, and during the second part to recharge the accelerator grid surface by electrons from the plasma source. Simultaneously, excess ions travel to the anode for neutralization.

Figure 15:
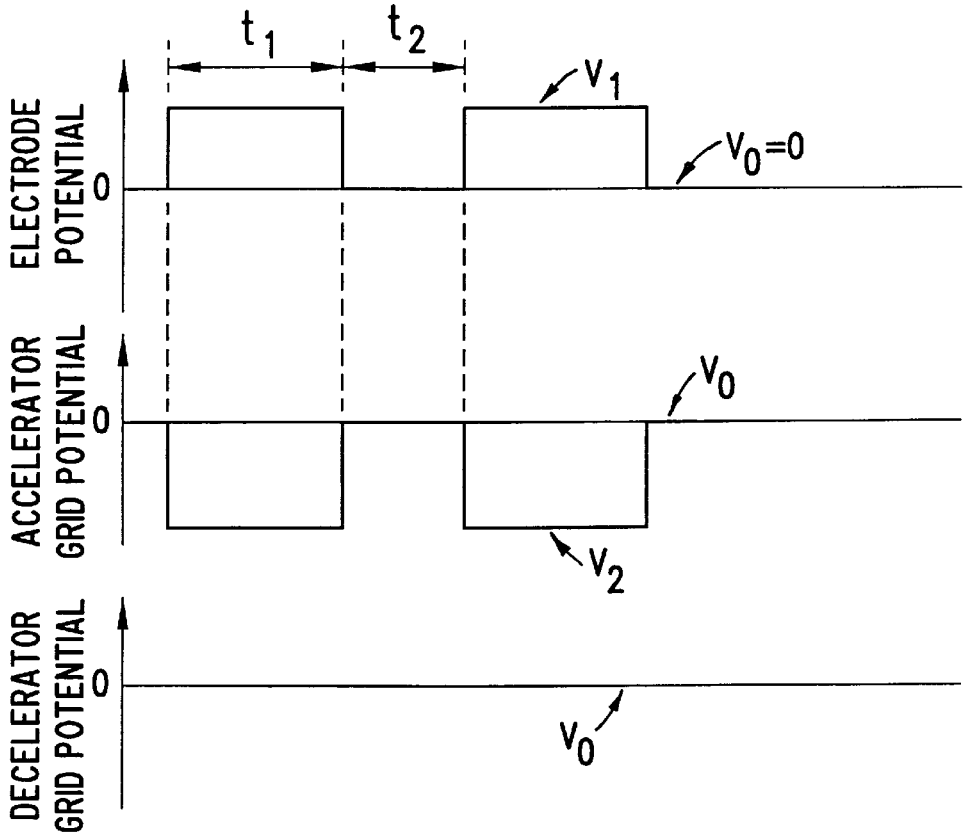
FIG. 15 is a graphical representation illustrating a second pulsed mode of operation of the charged particle source of the invention.

Another modification of the pulse mode of ion extraction in accordance with the invention is represented in FIG. 15. This mode of ion extraction prevents the impact of grid contamination if more than two grids are employed. An example of three grid optics (including a decelerator grid) is now discussed. During the first part of each period "$\tau_1$" the potential applied to the electron extraction electrode, i.e. anode, is set at the desired value for ion extraction $V_1$, and the accelerator grid is set at $V_2$. During the second part of the period "$\tau_2$" both grids are kept at ground potential. The decelerator grid is also alternated between its desired value for ion extraction in the first part of the period ($\tau_1$) and ground potential in the second part ($\tau_2$). It is usually just kept at constant ground potential. Unlike the previous pulse mode modification shown in FIG. 14, positively charged surfaces of all of the employed grids will be neutralized during the second half of the period in the same manner as it was described in the previous paragraph.

In accordance with the invention, the frequencies of the pulsed electrical fields for both pulse mode modifications represented in FIG. 14 and FIG. 15 preferably satisfy the following conditions:

1. The ion extraction time $\tau_1$ should be at least greater than the time "$t_1$" required for the ions to travel from the screen grid to the outermost grid, but short compared to the time "$t_2$" it takes for the surface potential alterations due to charging to become significant compared to the nominal grid potentials;

2. The time period during which ion extraction is interrupted should be greater than $t_3$, the time required for the neutralization of the accumulated charge. Estimated values of these time intervals are:

$$t_1>5.10^{-8}\text{ sec},\ t_2<10^{-4}\text{ sec},\ t_3>10^{-8}\text{ sec}.$$

Illustrative frequencies of the pulsed electrical fields that satisfy these conditions are in the range of from about 0.1 MHz to about 15 MHz.

While particular embodiments of the present invention have been shown and described, it will be obvious to those skilled in the art that changes and modifications may be made without departing from the invention in its broader aspects, and, therefore, the aim in the appended claims is to cover all such changes and modifications as all within the true spirit and scope of the invention.

We claim:

1. A charged particle source comprising:

a vessel defining an interior for containing a plasma, the vessel including an inlet communicating with the interior of the vessel and connectable to a source of atoms, and an aperture through which a charged particle beam is dischargeable;

an energy generator for communication with the atoms in the interior of the vessel and for effecting ionization of the atoms in the vessel and creating the plasma;

an electrode assembly disposed in the interior of the vessel, the electrode assembly including a conductive electrode support member, a tray member associated with said support member, a conductive liquid disposed in said tray member, said liquid having a surface area and a conductor connectable between said conductive liquid and a voltage source, and an ion optics assembly disposed adjacent the vessel aperture for accelerating plasma-generated charged particles having the same polarity as the conductive liquid from the vessel while maintaining charged particles of the opposite polarity within the vessel.

2. A charged particle source according to claim 1 wherein the energy generator is an RF energy generator.

3. A charged particle source according to claim 1 wherein the energy generator is a microwave energy generator.

4. A charged particle source according to claim 1 wherein said conductive liquid is gallium.

5. A charged particle source according to claim 1 which is an ion source, and wherein the voltage source is a positive voltage source.

6. A charged particle source according to claim 5 wherein said ion optics assembly includes first and second conductive grid members having a plurality of apertures, the first grid being in contact with the plasma and kept at floating potential or electrically connected to said electrode assembly, and the second grid being connected to a negative voltage source.

7. A charged particle source according to claim 5 wherein said conductive liquid comprises an anode having an effective extraction surface having an effective electron extraction area $A_a$, defined as about the surface area of said conductive liquid contacting the plasma and satisfying the following general plasma conditions:

$$I_{e,a}=0.25n_eeA_a\sqrt{(8kT_{e/\pi m_e})}\exp(-eU_s/kT_e)$$

$$I_{e,a}=I_b+I_{i,a}$$

$$I_{i,a}=n_{p,a}q_iA_a\sqrt{kT_{e/m_i}}$$

where "$I_{e,a}$" and "$I_{i,a}$" are the electron and ion currents, respectively, collected on the effective the surface of the liquid, lb is the ion beam current which is extracted from the source, and where k=Boltzmann's constant, "e"=the electron charge, "$q_i$" is the ion charge, $m_e$=the electron mass, $m_i$=the ion mass, n. =np,a the plasma density at the effective electron extraction area of the anode, $T_e$=the electron temperature of the plasma at the effective electron extraction area of the anode, and $U_s$ is the potential difference between the conductive liquid and the plasma.

8. A charged particle source according to claim 5 wherein said electrode assembly comprises an anode having an ion beam extraction area $A_g$ and wherein the plasma includes ions having a charge q, a mass $m_i$, the plasma having a density at the ion beam extraction area of $n_p$ and a density at the anode of $n_{p,a}$, the plasma further including electrons having a mass $m_e$ and a charge e, said anode having an effective electron extraction area $A_a$, defined as about a surface area of said conductive liquid contacting the plasma, satisfying the following general plasma conditions, for ion source operation at maximum beam current defined by:

$$A_a=A_g(q_np/n_{p,a})\sqrt{2\pi m_{e/m_i}}.$$

9. A charged particle source according to claim 5, wherein said electrode assembly comprises an anode having an ion beam extraction area $A_g$, the plasma having a density at the ion beam extraction area of $n_p$ and a density at anode of $n_{p,a}$, said anode having an effective electron extraction area for ion source operation, defined as about a surface area of said conductive liquid contacting the plasma, at maximum beam current, greater than $(n_p/n_{p,a})A_g/68$.

10. A charged particle source according to claim 5, wherein said electrode assembly comprises an anode having an ion beam extraction area $A_g$, the plasma having a density at the ion beam extraction area of $n_p$ and a density at the anode of $n_{p,a}$, said anode having an effective electron extraction area, defined as about a surface area of said conductive liquid contacting the plasma, for ion source operation at maximum beam current greater than $A_g/68$.

11. A charged particle source according to claim 5, wherein said electrode assembly comprises an anode having an effective electron extraction area defined as about the surface area of said conductive liquid contacting the plasma, said surface area being greater than about 5 $cm^2$.

* * * * *